US007322190B2

(12) United States Patent
Bair

(10) Patent No.: US 7,322,190 B2
(45) **Date of Patent: *Jan. 29, 2008**

(54) HYDRAULIC SYSTEM FOR SYNCHRONIZED EXTENSION OF MULTIPLE CYLINDERS

(75) Inventor: Eugene C. Bair, Holland, MI (US)

(73) Assignee: JR Automation Technologies LLC, Holland, MI (US)

(*) Notice: Subject to any disclaimer, the term of this patent is extended or adjusted under 35 U.S.C. 154(b) by 0 days.

This patent is subject to a terminal disclaimer.

(21) Appl. No.: 11/465,930

(22) Filed: Aug. 21, 2006

(65) Prior Publication Data

US 2006/0283321 A1 Dec. 21, 2006

Related U.S. Application Data

(63) Continuation-in-part of application No. 10/945,830, filed on Sep. 21, 2004, now Pat. No. 7,134,280, which is a continuation-in-part of application No. 10/894,713, filed on Jul. 20, 2004, now Pat. No. 7,047,738.

(60) Provisional application No. 60/543,068, filed on Feb. 9, 2004.

(51) Int. Cl.
*F15B 7/00* (2006.01)

(52) U.S. Cl. ..... 60/546; 60/593; 91/515

(58) Field of Classification Search ..... 60/546, 60/581, 593; 91/515
See application file for complete search history.

(56) References Cited

U.S. PATENT DOCUMENTS

| | | | |
|---|---|---|---|
| 1,831,238 | A | 11/1931 | Ferris |
| 2,499,563 | A | 3/1950 | Bill |
| 2,983,256 | A | 5/1961 | Seeloff |
| 2,997,849 | A | 8/1961 | Shimanckas |
| 3,157,032 | A | 11/1964 | Herpich |
| 3,257,810 | A | 6/1966 | Hanni |
| 3,316,817 | A | 5/1967 | Ellis |
| 3,590,581 | A | 7/1971 | Bianchi |
| 3,625,115 | A | 12/1971 | Shoichi Tani et al. |
| 3,643,725 | A | 2/1972 | Fismer |
| 3,680,339 | A | 8/1972 | Hayakawa |
| 3,769,881 | A | 11/1973 | Aoki |
| 3,776,300 | A | 12/1973 | Fismer |
| 3,783,620 | A | 1/1974 | Moe |
| 3,832,852 | A | 9/1974 | Schmucket |
| 4,006,664 | A | 2/1977 | Brown |
| 4,161,229 | A | 7/1979 | Mifsud |
| 4,164,122 | A | 8/1979 | Ward |
| 4,241,581 | A | 12/1980 | Chace |

(Continued)

*Primary Examiner*—Michael Leslie
(74) *Attorney, Agent, or Firm*—Price, Heneveld, Cooper, DeWitt & Litton LLP

(57) ABSTRACT

A hydraulic system maintains squareness while extending an object via two lift cylinder assemblies. A hydraulic circuit is connected to the cylinder assemblies, and includes synchronizer with multiple isolated chambers corresponding to the cylinder assemblies, a rod extending axially through the chambers, and pistons mounted on the rod and associated with the isolated chambers. The hydraulic circuit operably connects a pump to the synchronizer and to the cylinder assemblies for controlling and providing synchronized movement of the cylinder assemblies. The hydraulic circuit includes valving for an automatic re-synchronization cycle, fill cycle, and air purge cycle. The system is effective for moving large objects in a non-binding manner, such as an extendable room on a recreational vehicle, while maintaining accurate squareness.

26 Claims, 26 Drawing Sheets

U.S. PATENT DOCUMENTS

| | | | | |
|---|---|---|---|---|
| 4,251,993 | A | 2/1981 | Vancil | |
| 4,351,153 | A | 9/1982 | Kosmala | |
| 4,585,172 | A | 4/1986 | Gazzera | |
| 4,624,126 | A | 11/1986 | Avila et al. | |
| 5,141,112 | A | 8/1992 | Holbert | |
| 5,320,047 | A | 6/1994 | Deurloo et al. | |
| 5,390,586 | A | 2/1995 | Jones | |
| 6,026,934 | A | 2/2000 | Deurloo | |
| 6,408,736 | B1 | 6/2002 | Holt et al. | |
| 7,047,738 | B2 * | 5/2006 | Bair | 60/546 |
| 2003/0140628 | A1 | 7/2003 | Gai | |
| 2004/0020197 | A1 | 2/2004 | Cray | |

* cited by examiner

HYDRAULIC SYSTEM FOR SYNCHRONIZED EXTENSION OF MULTIPLE CYLINDERS

This application is a continuation-in-part of patent application Ser. No. 10/945,830, filed Sep. 21, 2004 now U.S. Pat. No. 7,134,280, entitled HYDRAULIC SYSTEM FOR SYNCHRONIZED EXTENSION OF MULTIPLE CYLINDERS, which in turn is a continuation-in-part application of patent application Ser. No. 10/894,713, filed Jul. 20, 2004 now U.S. Pat. No. 7,047,738, entitled HYDRAULIC SYSTEM FOR SYNCHRONIZED EXTENSION OF MULTIPLE CYLINDERS, which in turn claims benefit under 35 USC 119(e) of provisional application Ser. No. 60/543,068, filed Feb. 9, 2004, entitled HYDRAULIC SYSTEM FOR SYNCHRONIZED EXTENSION OF MULTIPLE CYLINDERS, the entire contents of which are incorporated herein in their entirety.

BACKGROUND

The present invention relates to a hydraulic system for synchronized extension of two or more cylinders. For example, the present invention is useful on a lift table where table surface must be raised and/or lowered while maintaining levelness, despite non-uniform loads. However, the present apparatus is not believed to be limited to only this particular application, since distribution of identical amounts of hydraulic fluid can be used very effectively in many different applications. Also, the present invention includes additional aspects, including an automatic resynchronization sequence, a filling sequence without the need to draw, bleed, or to evacuate hydraulic lines, and an air purge sequence also without the need to draw a vacuum or bleed hydraulic lines.

Many attempts have been made to synchronize hydraulic systems in the past. Generally these synchronizing systems use multiple gear pumps on a common shaft, one for each cylinder, or special proportioning valves, or other means in an attempt to deliver an identical amount of hydraulic oil to each cylinder. None of these systems are completely successful because loss of oil in the various devices accumulate and adversely affect synchronization. For example, the gear units have losses around the sides of the gears and through the gear tooth surfaces. The systems using proportioning valves also experience oil loss because of the clearance between the valve body and the spool. Oil leaks and entrapped air and non-uniform loading also adversely affect synchronization and cause dissimilar extension of cylinders.

The loss of oil in any individual cylinder circuit especially hinders the functionality of the multi-cylinder system to move or lift objects in the intended even manner. Generally the loss of oil is a function of a number of operating cycles and the load applied to the cylinders. The worst case is demonstrated when the load is not evenly distributed between all of the cylinders being used. If a higher percentage of the load is assigned to one of the cylinders, then the leakage found in that cylinder circuit will be greater in volume than the leakage in the rest of the circuits. Over time, the higher leakage in one of the cylinder systems will cause the lifting cylinders to go out of phase and subsequently cause the system to fail. Also, many synchronized hydraulic systems that use multiple cylinders in parallel will bind and cause stress concentrations leading to premature wear and increased maintenance.

Resynchronization and line-purging to eliminate trapped air in known synchronized hydraulic systems is undesirably time-consuming and labor-intensive, and is difficult to accomplish without messy maintenance procedures such as disconnecting, bleeding, and reconnecting hydraulic lines. Further, repeated disconnections and re-connections undesirably increase the risk of new leaks. There are many situations when it is very desirable to use two cylinders to move an object. Sometimes more force is required than can be developed with one cylinder. In other cases the object is rectangular such as a table, or a press ram, or a slide of some sort. In most cases these items are wide enough to be unstable if operated by one center mount cylinder. In order to use one center mount cylinder very heavy bearing guides must be provided at the outer edges of the moving object to keep it from twisting or racking. It is usually not desirable or possible to provide such guidance because of physical restrictions or cost. Sometimes the framing of the system is not strong enough to provide adequate support.

The solution to all of these problems is to use some means of developing synchronized push/pull force at two points, mounted far enough apart to give a stable operation to the motion of the object. Traditionally there have been two methods of developing two point synchronized motion. 1. Use two screws of some sort that are operated together by a gear train or timing belt. 2. Use two rack and pinion systems connected together by a common shaft. Both systems require an electric motor to provide rotation and both are expensive. In the past all attempts to use air or hydraulic means to provide two point force to move an object has failed because the cylinders do not stay synchronized. Providing heavy guide bearing to force synchronization does not help and is counter to design and cost constraints.

Thus, an apparatus having the aforementioned advantages and solving the aforementioned problems is desired.

SUMMARY OF THE PRESENT INVENTION

In one aspect of the present invention, an apparatus for non-binding, non-skewed movement of an object while maintaining squareness to an original position includes at least two cylinder assemblies connected to an object for extending and retracting the object. A synchronizer has at least two isolated chambers corresponding to the at least two lift cylinder assemblies, a rod extends axially through the chambers, and pistons are mounted on the rod with one of the pistons being located in each of the isolated chambers. The chambers include first and second passageways extending into opposite ends of each of the chambers. An axial passageway extends continuously through the rod and connected to the first passageways for communicating hydraulic fluid to each first passageway. The apparatus also includes a hydraulic pump. A hydraulic circuit operably connects the pump to the axial passageway of the synchronizer and to the second passageways of the synchronizer and to the at least two cylinder assemblies for controlling and providing synchronized movement of the at least two cylinder assemblies.

In another aspect of the present invention, a hydraulic apparatus includes two cylinder assemblies adapted for connection to an object for synchronized extension and retraction to move the object along a defined path while maintaining a precise orientation. A synchronizer has two isolated chambers corresponding to the two cylinder assemblies. A rod extends axially through the chambers, and pistons are mounted on the rod and located in the isolated chambers. The apparatus also includes a hydraulic pump. A hydraulic circuit operably connects the pump to the synchronizer and to the two cylinder assemblies for controlling and providing synchronized movement of the two cylinder assemblies, the hydraulic circuit including hydraulic fluid and including a valving arrangement configured to automatically purge air entrapped in the hydraulic fluid without disconnection of any hydraulic lines and without evacuation or bleeding of the hydraulic lines.

These and other aspects, objects, and features of the present invention will be understood and appreciated by those skilled in the art upon studying the following specification, claims, and appended drawings.

DETAILED DESCRIPTION OF PREFERRED EMBODIMENTS

The present apparatus 10 (also called a "hydraulic system" herein) (FIGS. 1A-1B) includes a hydraulic circuit and components that achieve full and reliable synchronous operation of multiple hydraulic cylinders. In the illustrated system, the cylinders used have similar areas in order to provide synchronized identical stroke actions.

Figure 1A:
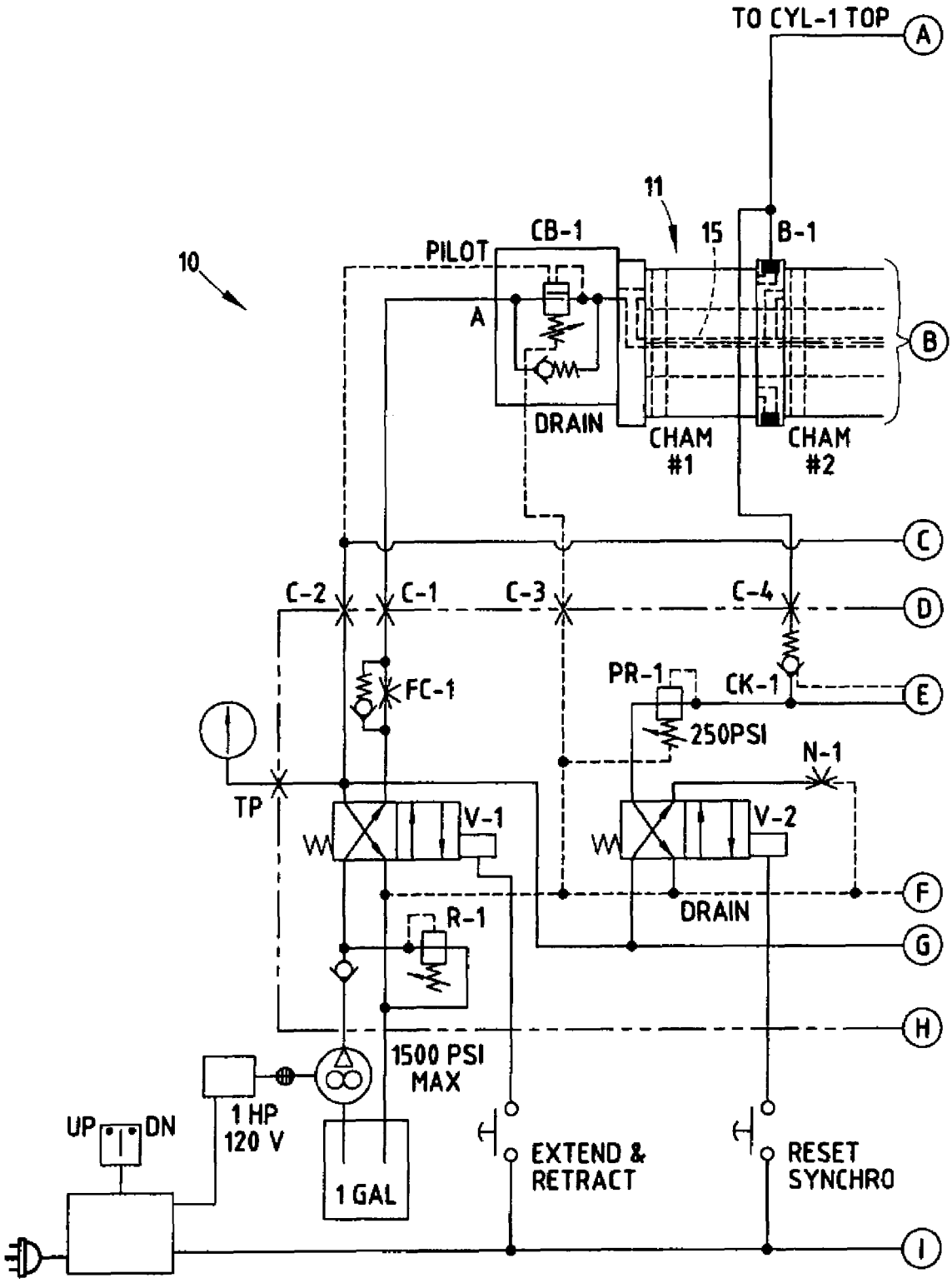
FIGS. 1A-1C combine to form a hydraulic drawing of an apparatus including a lift table, four lift cylinders, one at each corner, a synchronizer, a pump, and related hydraulic lines and valving arrangement embodying the present invention.
Figure 1B:
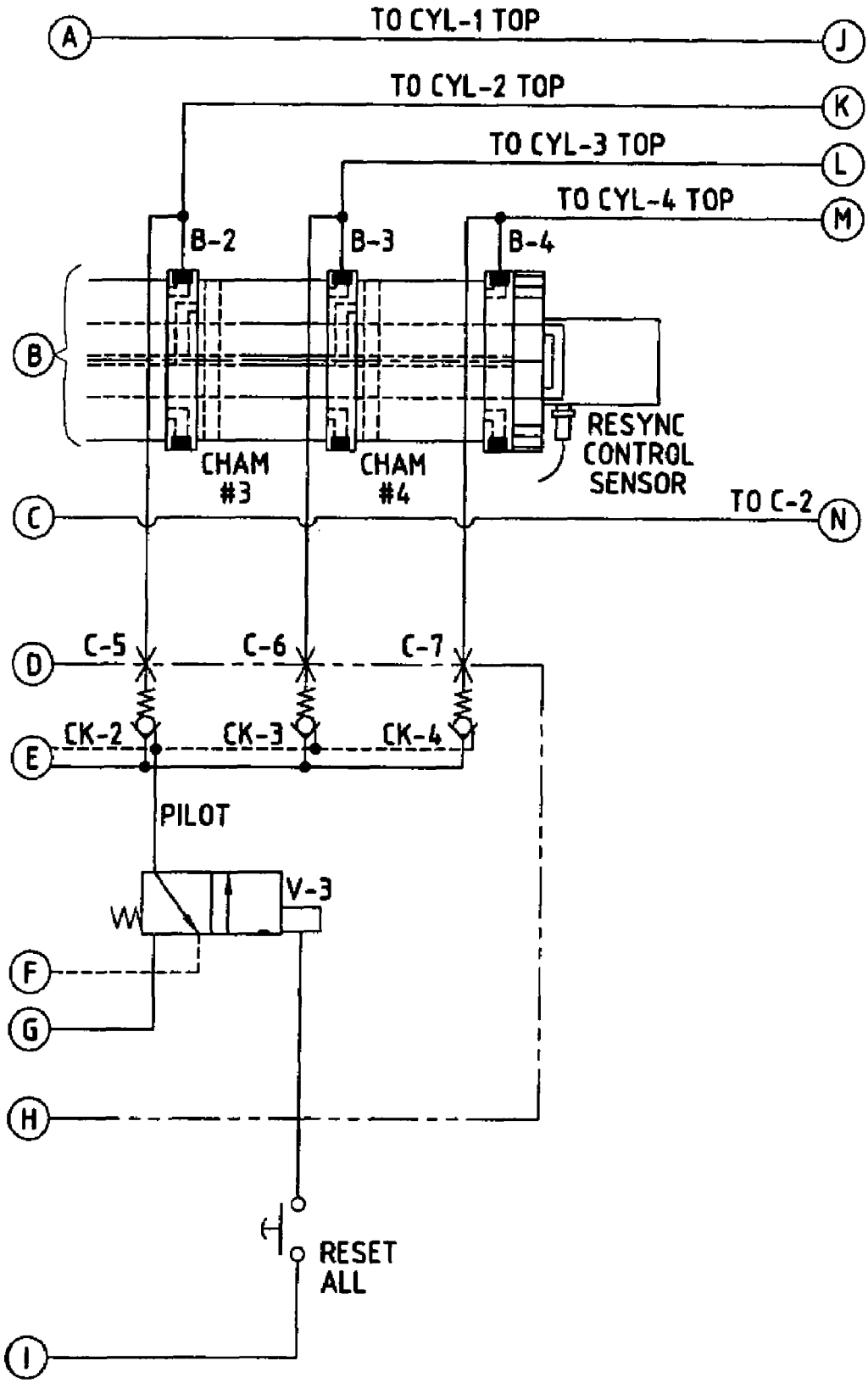
Figure 1C:
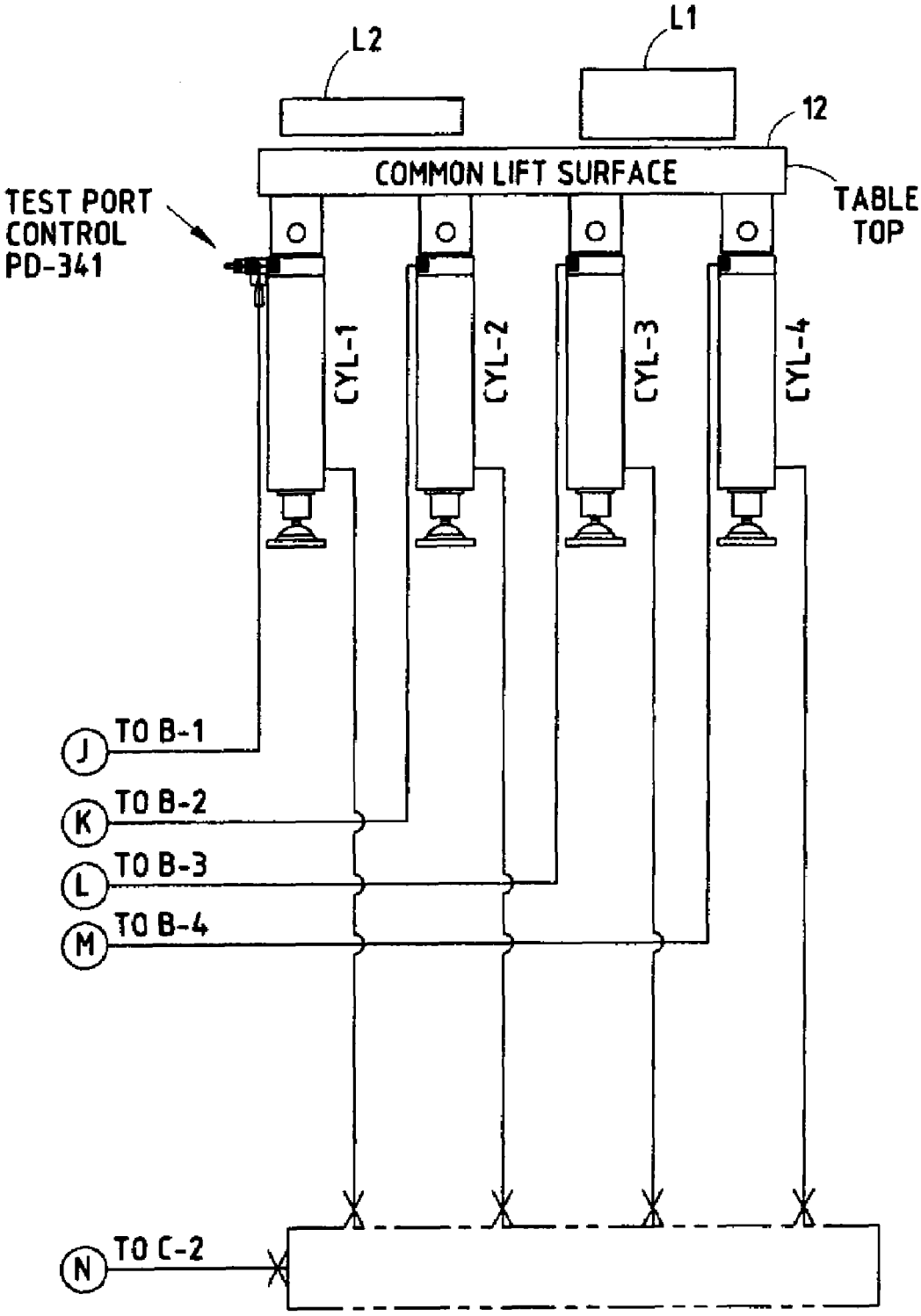

The illustrated apparatus 10 (FIGS. 1A-1C) includes four cylinders CYL-1, CYL-2, CYL-3, CYL-4 for lifting a table having a support surface 12 uniformly in a level manner without binding, even where there is an unbalanced load such as a heavier load L1 in one location and a lighter load L2 in another location on the table or lift surface. The apparatus 10 includes a synchronizer 11 having four chambers CHAM#1-CHAM#4 operably connected to a top of each of the cylinders CYL-1-CYL-4 by individual hydraulic lines. The synchronizer 11 includes a supply-side end plate, and a series of (four) cylinder walls and (three) intermediate end plates and another end plate that define the chambers CHAM#1-CHAM#4. A series of rods and piston heads are threaded together to define a stacked arrangement, with a piston head being located in each chamber CHAM#1-CHAM#4, and a rod extending through each of the four end plates. Solenoid valves V-1, V-2, and V-3, control valve CB-1, and various pressure regulators R-1, PR-1, flow control restrictors FC-1, and check valves CK-1, CK-2, CK-3, CK-4 are interconnected as shown in FIGS. 1A-1B to accurately control a balanced hydraulic fluid flow to and from each of the cylinders. Further, the arrangement allows automatic re-synchronization and air purging, as discussed below.

The attached circuit design addresses the above problems by creating a very robust system and providing a means of restoring the system if synchronization fails. In this example (4) four hydraulic cylinders are used, however any number of cylinders could be used. The system can also be sized to accommodate larger or smaller diameter cylinders, and differently sized cylinders. The illustrated cylinders #1 through #4 have a 2 inch bore and each has an area 3.1416 square inches. These cylinders are very heavy construction with very large rods and are equipped with heavy-duty seals. The operating clearances are minimized to prevent side movement, which is a prerequisite for use in machine lift table applications. The desired stroke in this example is 12 inches. It requires 37.69 cubic inches of oil for the desired stroke of each cylinder. A flexible hose connects each 2-inch cylinder with one of the chambers marked #1 through #4 of a synchronizing device. The lift surface (FIG. 1B) can have bottom brackets attached to the outer cylinder casings, or can have brackets welded directly to sides or ends of the cylinder casings, or can be attached in other ways known in the trade.

Figure 10A:
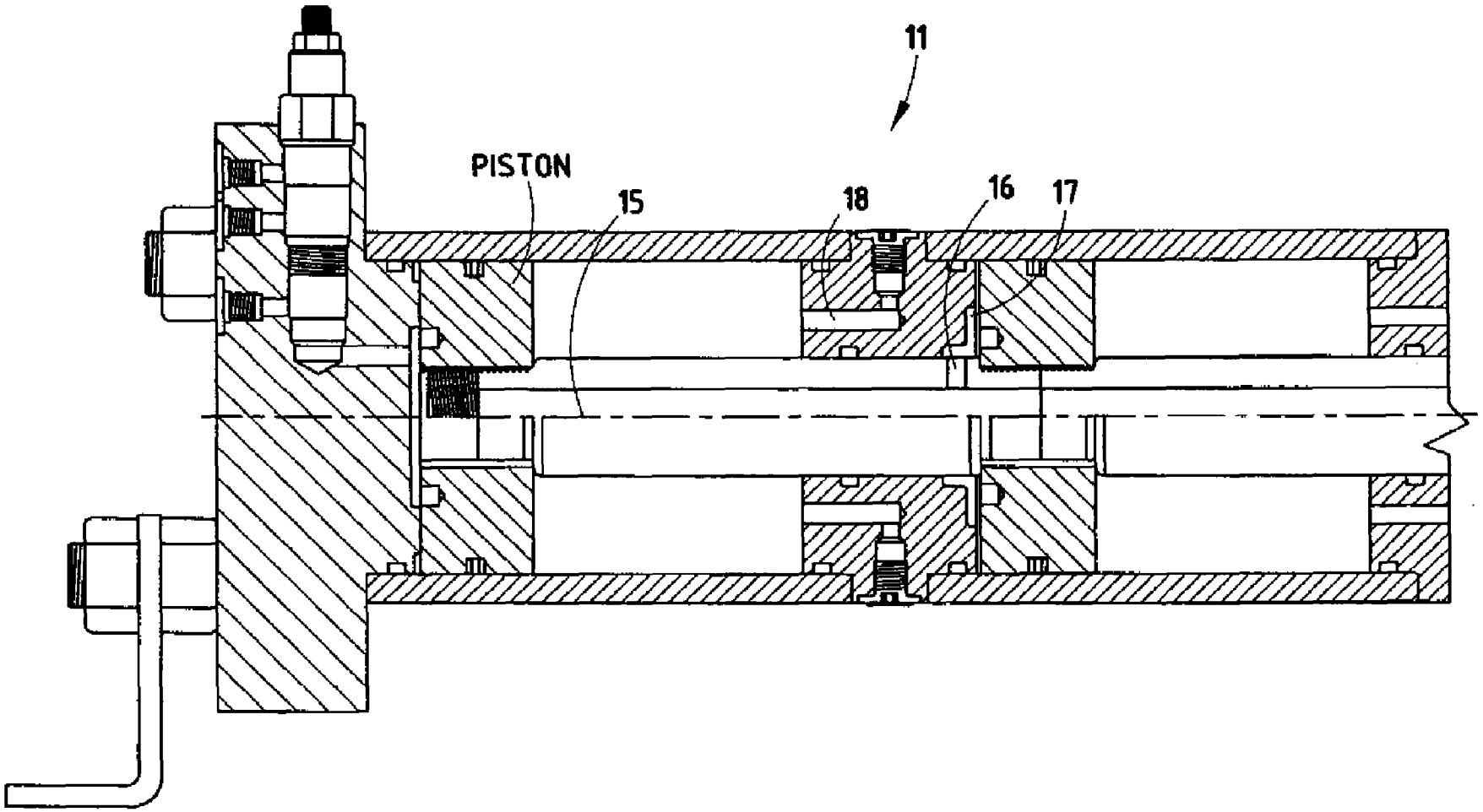
FIGS. 10A-10B combine to form a side cross-sectional view of the synchronizer of FIG. 1.
Figure 10B:
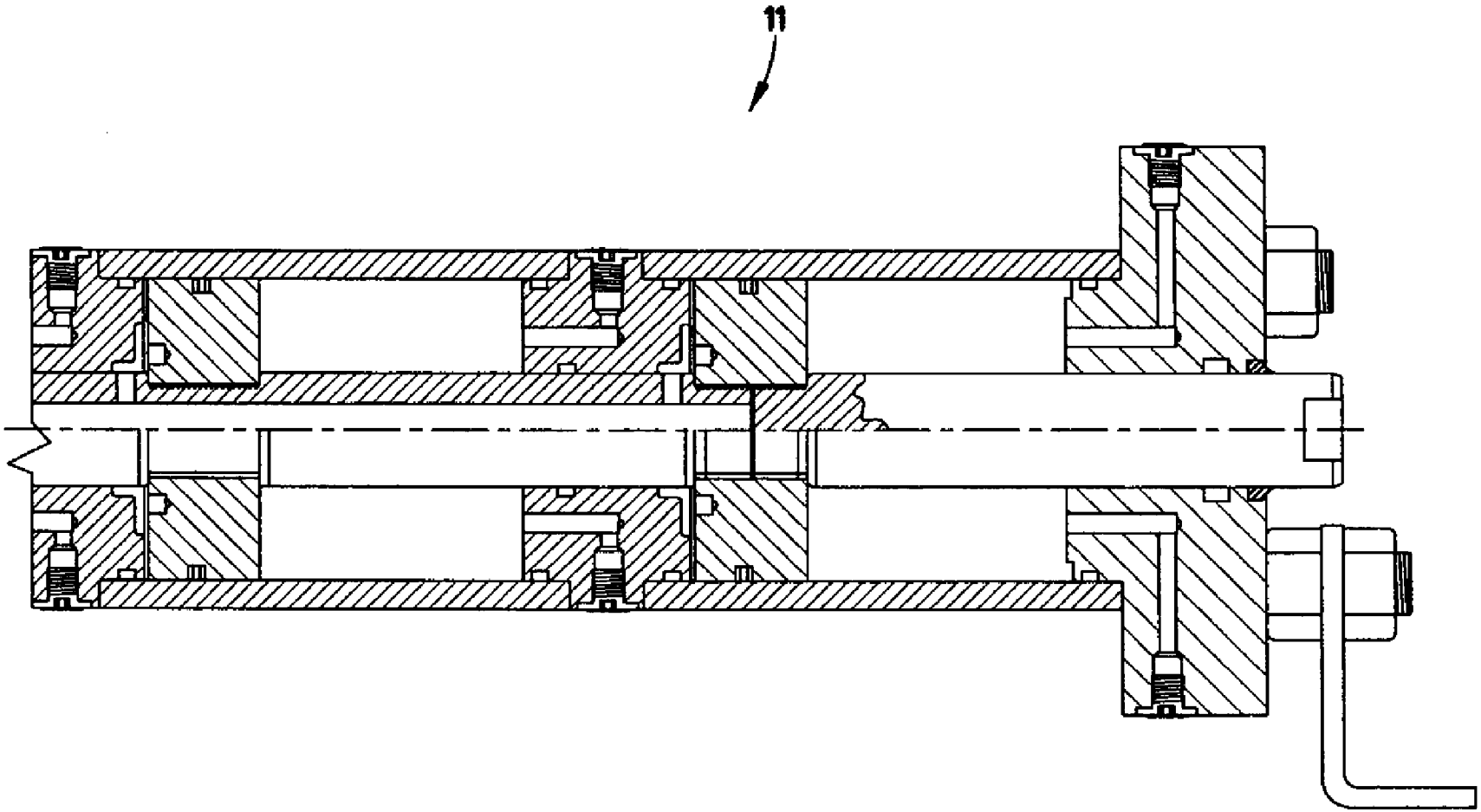
Figure 11B:
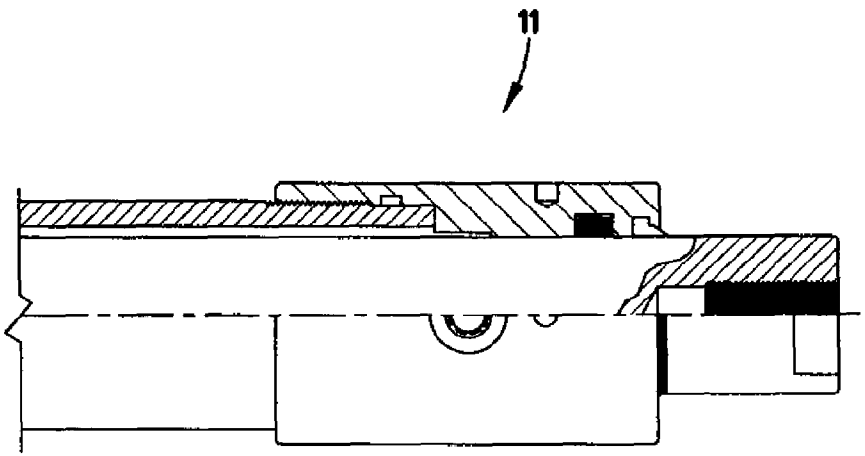
FIGS. 11A-11B combine to form a side cross-sectional view of the rod assembly of FIGS. 10A-10B.
Figure 11A:
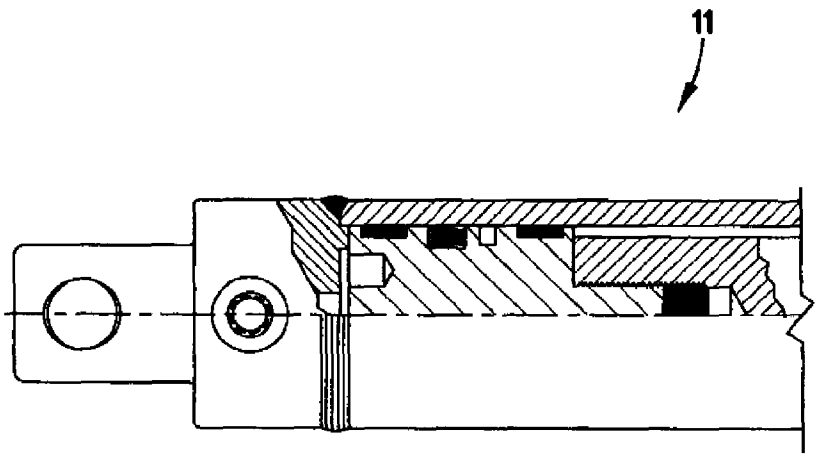

The synchronizer 11 has four separate and isolated chambers with identical areas and volumes. The illustrated chambers are axially aligned, and are formed by cylinder side walls and end plates. The volume of each chamber is the amount required to furnish the 37.69 cubic inch of oil required by each attached 2-inch cylinder. Each chamber has a piston assembly and a piston rod. All of the piston rods are connected together, such as by threaded axial connection. The piston rods have an internal axial passageway 15 (FIGS. 10A-10B) that extends continuously through the assembled rods and first cross-drilled ports 16 extending from the axial passageway into each chamber, such as through a passageway 17 in the end plates. Second cross-drilled ports 18 extend from each chamber outwardly through the end plates. The first and second cross-drilled ports (FIGS. 1A and 1B) are operably connected to the hydraulic system to communicate hydraulic fluid into opposite sides of each piston. A step (FIG. 10A) is formed on the plates around a perimeter of each cavity, but spaced inwardly slightly from the radial edges of the cavity. The step does not act as a stop to limit movement of each piston against an end of the respective chambers, but does provide ingress and egress openings into each of the first and second ports that are always open for uniform inflow and outflow of hydraulic fluid.

The common piston rod (FIGS. 10A-10B) causes all of the piston assemblies to move together in linear axial fashion. Oil from a pressure source through port A is directed through a passageway 15 in the piston rods into all of the chambers. The cylinder assemblies will receive the oil and will be urged to move toward the opposite end of the chamber. The amount of motion and the speed of the motion will depend on the volume of oil being delivered from the pressure source. In the attached circuit design, if the piston assembly in chambers #1 through #4 (FIGS. 1A-1B) is in the at home position, 37.69 cubic inches of oil will be located in each chamber. Each chamber has a connection to an individual cylinder through ports B1 through B4. If oil under pressure is introduced into the chambers through port A and the piston rod passageway then the piston assemblies moving under that pressure will force oil out of Port B of each chamber The oil being forced out of the four chambers through the B ports will be equal in volume. The combination of pistons and interconnecting piston rods is dimensionally made to assure that internal pressure developed on the pistons in the synchro chamber, if the synchro is fully stroked, is always directed through the piston rods to the end piston against the end caps of the synchro and not in the middle chambers. The intent of this design is to prevent tension loads on the piston rod and threads. That idea and the heavy construction with very aggressive seals guarantee a long service life.

It will be understood by those skilled in the art that oil from a pressure source introduced into Port A is isolated, by the use of seals, from oil that flows in and out of Ports B1 through Port B4. It will also be understood that by those skilled in the art that the hydraulic pressures in each chamber will be in equilibrium for balanced loads and will contribute to long seal life. The action of stopping the movement of the piston assembly by striking the end cap controls the volume of oil discharged from each chamber.

Operation of the system is as follows. In order to extend cylinders #1 through #4 the pump and motor must be operated. Oil from the pump is directed through normally open valve V-1 through port A of the counterbalance CB-1 and into Chamber #1. Oil enters the center hole in the piston rod in chamber #1 and then enters Chambers #2 through 4 through cross-drilled holes in the piston rod. Pressure and volume from the pump will cause the piston assemblies to stroke forward simultaneously. That action will cause oil to be discharged from the B Port of each chamber. Hose connections from the B Port of each chamber to the blind end of each 2-inch cylinder will cause the cylinder to begin to extend. In this example chamber #1 is connected to cylinder #1, etc. The extension rate and total stroke of each cylinder will be perfectly matched to the volume of oil received from each chamber of the synchronizer system. This action can raise or move an object using the uniform motion of the cylinders. Oil from the rod end of the cylinders will be directed to the system reservoir through the tank port of V-1.

The full stroke that is obtainable is, in this example, 12 inches. It is possible to stop the extension of the cylinders at any position less than 12 inches by stopping the pump. When the pump is stopped, oil that has been delivered to the cap end of the cylinders through the action of the synchronizer device will be prevented from returning by the counterbalance valve CB-1. The CB-1 valve prevents the cylinders from retracting and keeps the table at a selected level until a height change needs to be made.

To lower the table requires the hydraulic pump to be operated and V-1 to be energized. When this occurs, oil is directed to the rod end of the cylinders and to the pilot port of CB-1. The counterbalance valve will be forced to open and that action will allow oil from the cap end of the cylinders to flow into port B of the synchronizer. Load pressure from the cylinders #1 through #4 will force the piston assemblies in the synchronizer to reverse direction and force oil out of the A port. The cylinders will retract as long as V-1 and the pump motor are energized. The retract will stop quickly and hold the desired position if power is removed from those items.

Several additional features are provided that are required for proper operation of this system. V-2 and pressure regulator PR-1 are provided to furnish oil under pressure through the check valves to ports B1 through B4 on the synchronizer. This is used either during the initial start up of the system or if the system requires resynchronization. The circuit is intended to furnish oil to the four chambers making sure that the synchronizer is at the home position during the resynchronizing operation.

Valves V-3, and the pilot operated check valves are used to allow trapped air to be bled from the cylinders. This feature is useful during initial startup to purge the system of air or during resynchronization for the same purpose. Advantageously, this air purge can be done without having to evacuate the hydraulic lines and without having to draw a vacuum on the hydraulic lines and without having to bleed the lines. The plumbing connection is at the top of the system at the cap end of the cylinders. This high point is the most advantageous point to allow air to be purged from the system. The operation of V-3 directs oil to the pilot check valves. When the checks open, the four corner cylinders are allowed to bypass the synchronizer and to fully retract to home position. Oil that might contain air is directed from the cylinders to the system reservoir instead of to the synchronizer.

N-1 is a needle valve and is used to bleed oil from the pump circuit to balance the pump flow to the requirements of the system. In the design of the table lift system it is important that the cylinder rods be as large as possible for column strength. That feature causes a large area/volume difference between the cap end and the rod end of the cylinders. That large volume difference causes an unstable circuit condition to occur (e.g. hydraulic chatter). That problem is corrected by adjusting valve N-1 to achieve a smooth operation when the table is being lowered.

With the use of V-1, V-2, and V-3 in the proper sequence, the table lift system can be filled with oil and purged of air during the initial startup and resynchronized whenever it is required. This is an important feature that allows this system to be used long term successfully even though leakage might occur.

Hydraulic Lift Table Maintenance Procedures

For the original installation, the synchro unit and the power unit with the valve manifold block are all to be located according to a furnished plan, on the sheet metal drip pan base. All of these components when mounted to drip pan base form a common table control device for a wide range of tables, such as those adapted to provide up to 18,000 lb lift. Preferably, ¼ inch steel hydraulic tubing and good quality seal lock fittings should be used for all of the component interconnections. It is also preferable to use good shop practices, such as by keeping all components and lines clean, and by making all bends and tubing runs neat and orderly. Notably, the entire system can be assembled and plumbed on the bench for installation to a machine frame at a later date. The counterbalance valve located in the synchronizer should also be selected for the load. When all of the hydraulic connections have been made, the reservoir should be filled with hydraulic oil, and additive as required for the intended use.

Figure 2:
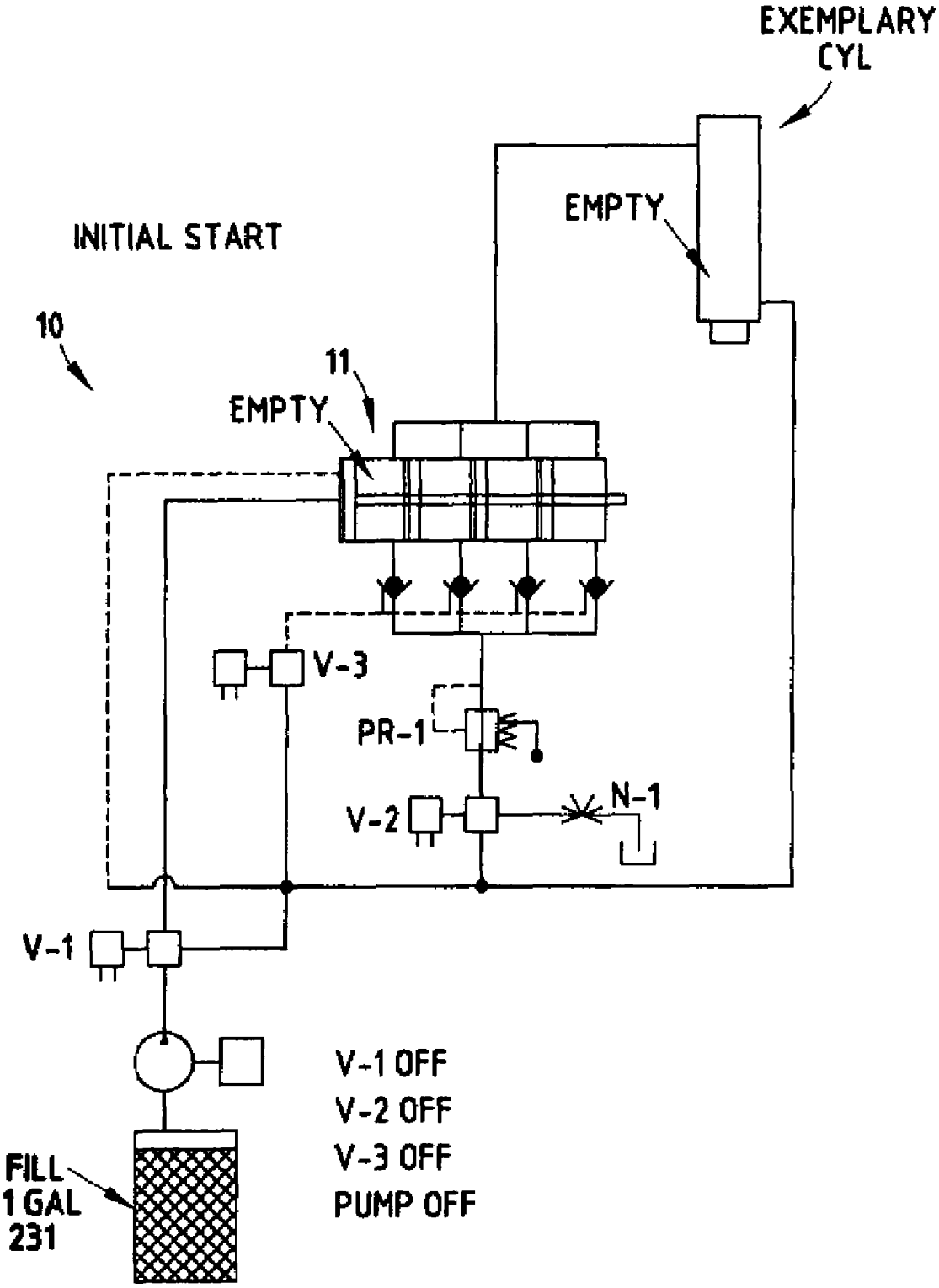
FIGS. 2-9 are hydraulic drawings showing the apparatus of FIG. 1 in various operative positions.
Figure 3:
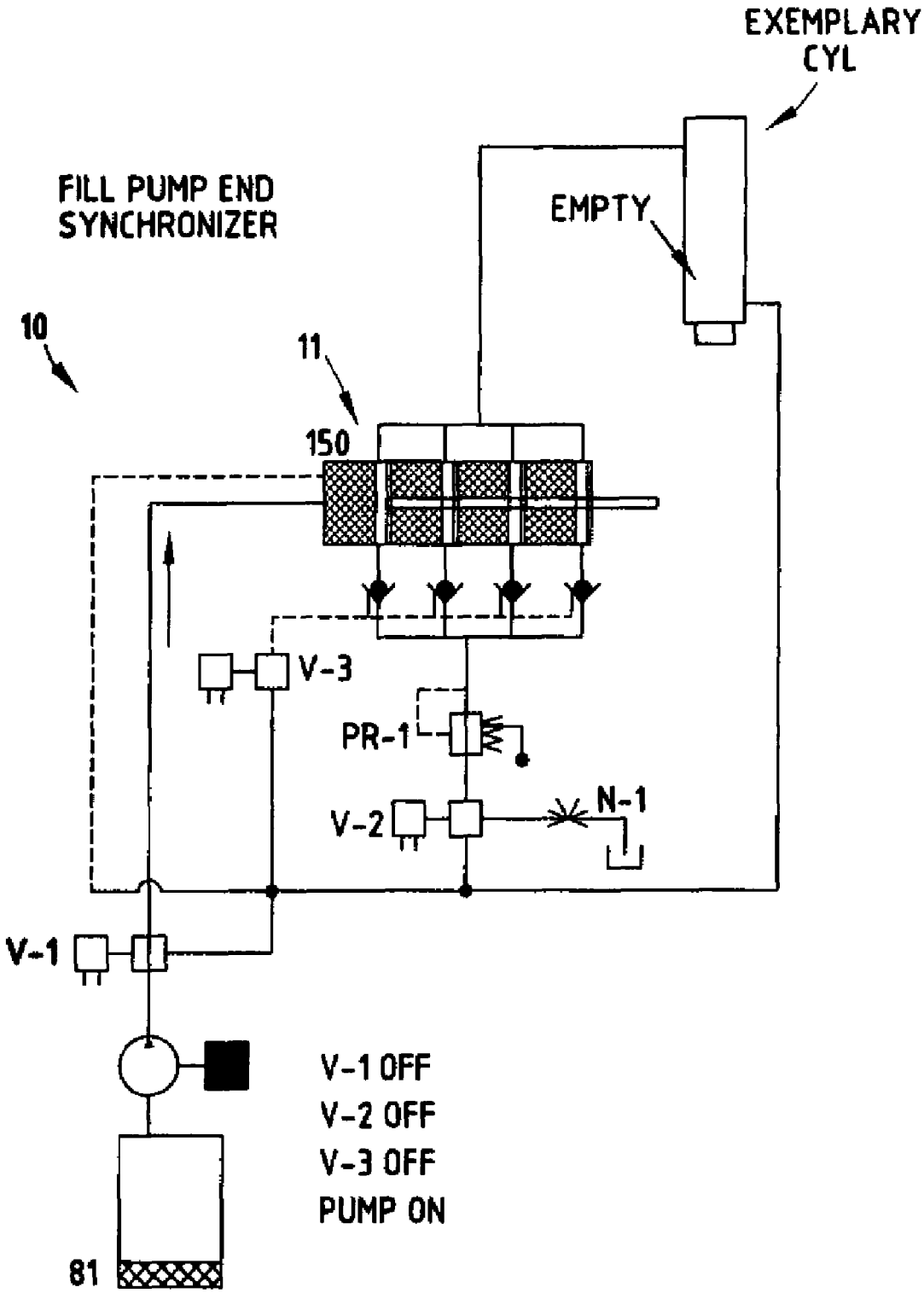

The following adjustments should be made before the pump is started (FIG. 2). Adjust the counterbalance valve to a maximum counterbalance relief setting (such as 1400 psi), and then adjust it downwardly to a desired load rating. Locate PR-1 on the valve block and remove the protective cap on the end of the valve. Locate the needle valve on the same block and turn it clockwise to close it. Snap a gauge on the test port (C-2) on the valve block and the cap end of the test cylinder. The power unit as delivered may be preset or adjusted as desired, such as to 1400 psi. Stan the pump with V-1, V-2, V-3 off (FIG. 3). This will direct oil through the counterbalance valve into the synchro system. Keep the pump energized until the synchro is fully extended. Hold the pump on while adjusting the relief valve pressure as per the load table below. The table cylinders might begin to rise but that is not important at this junction.

When the synchro is fully extended and the pressure has been set, stop the pump. Energize V-2 and V-1, keeping V-3 off (FIG. 4), and then operate the pump. As you keep the pump on, check the cylinder gauge, and adjust PR-1 for 200 to 250 psi. Observe the movement of the synchronizer, and keep the pump on until the synchro is fully retracted. Verify the pump pressure setting.

Figure 5:
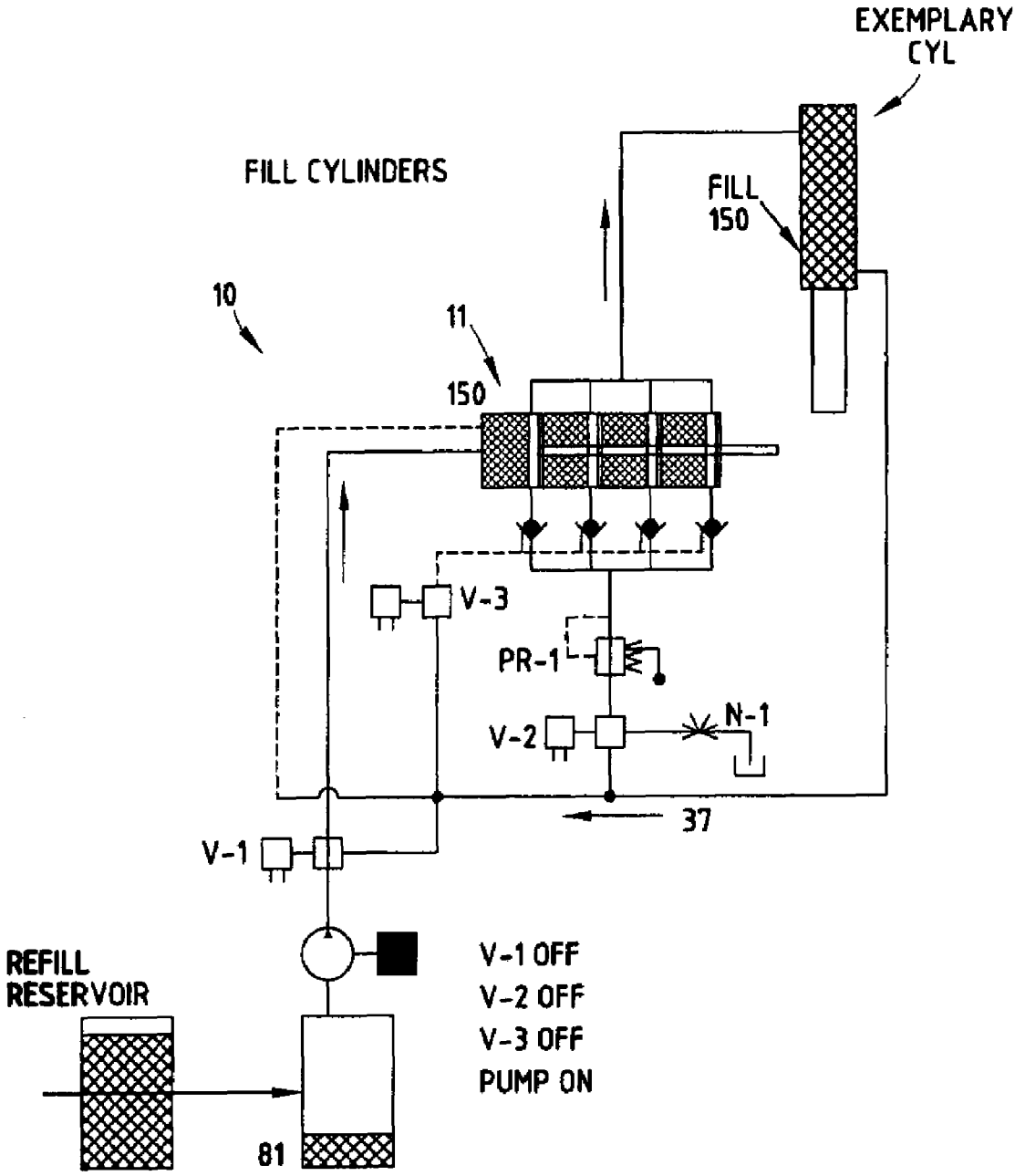

When the synchronizer has fully retracted, turn the pump off (FIG. 5). Turn off V-1 and V-2. Put the cap back on PR-1. The oil reservoir must be refilled at this point before proceeding. Now with V-1, V-2 and V-3 off, start the pump. That action will cause the synchro to advance directing oil to the cap ends of the four cylinders. Keep the pump on until the cylinders are fully extended approximately 12 inches, and turn the pump off.

Figure 6:
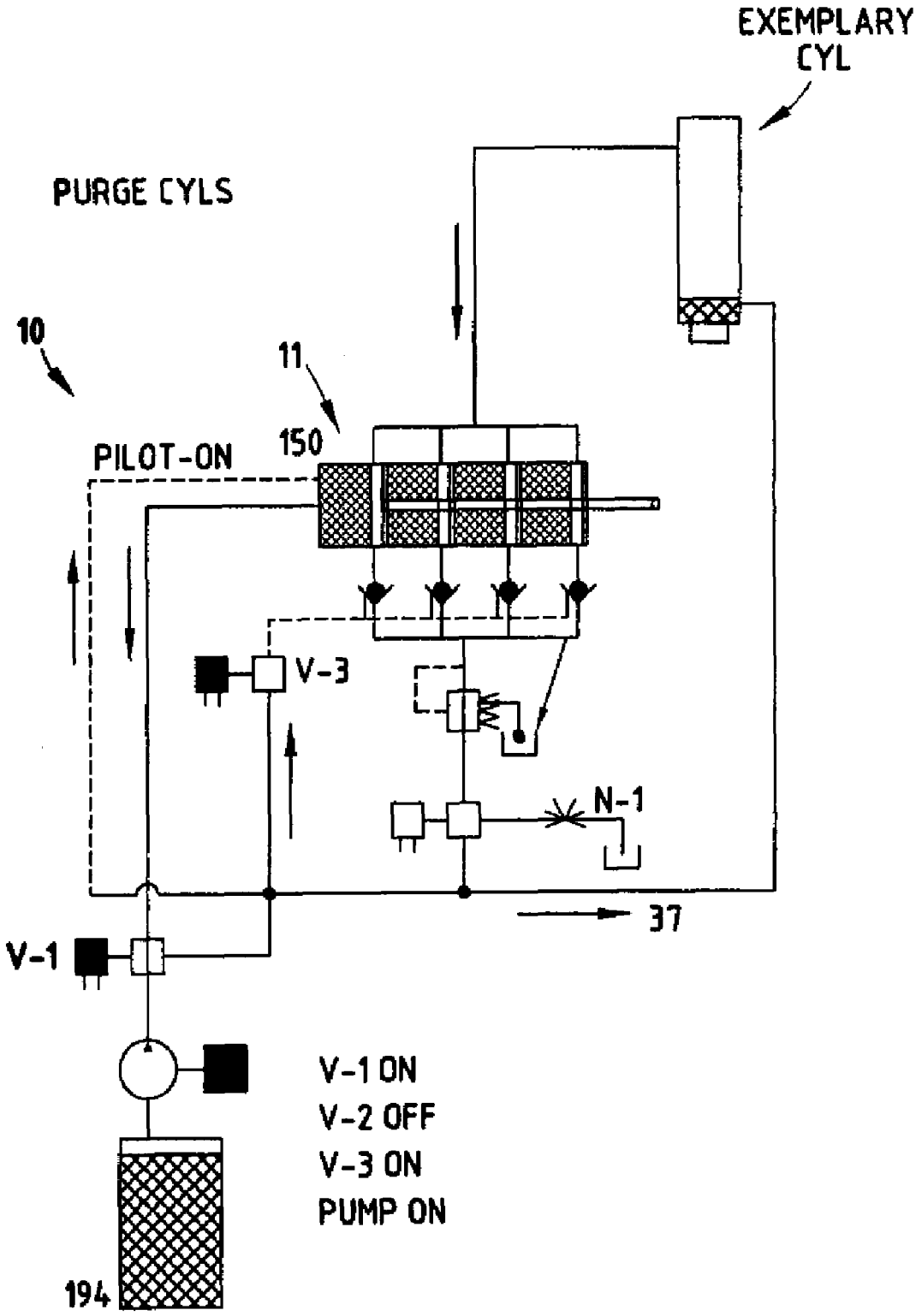

Energize V-1 and V-3 while leaving V-2 off, and turn on the pump (FIG. 6). This action will cause the table corner cylinders to retract. The synchro unit should not move while the cylinders retract. All of the oil that is in the four cylinders is being transferred back to the reservoir during this phase of the start-up procedure. The four cylinders might not retract at the same rate but that is okay. As soon as the cylinders are fully retracted shut off the pump.

Figure 7:
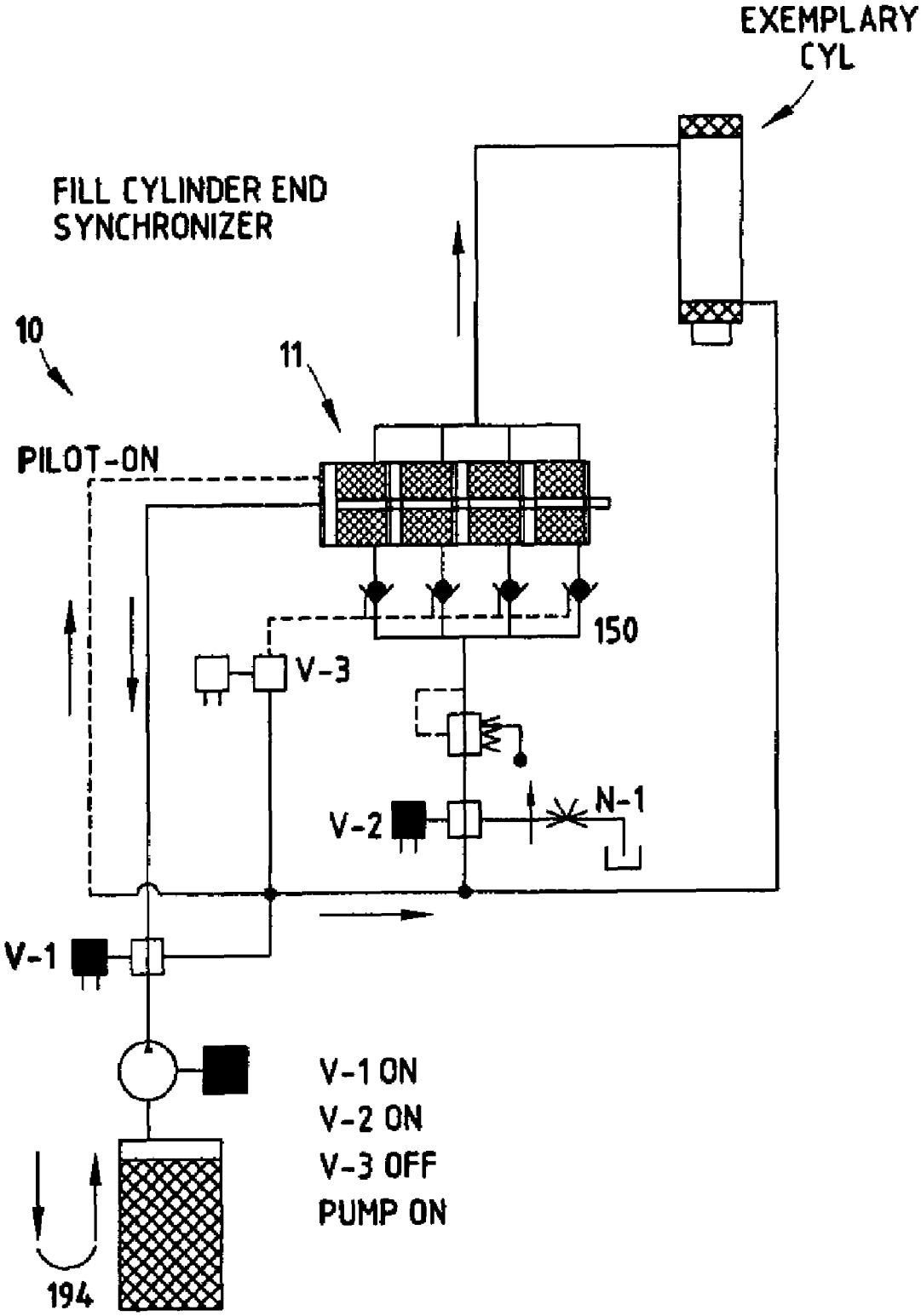

Turn V-3 off, energize V-2 and V-1, and operate the pump (FIG. 7). The synchro will retract to home position. Observe the gauge on the cap end of the cylinder. It should show the pressure setting of 200/250 psi. With the table completely down and the synchro at home position, check the fluid level in the reservoir. The level should be full.

Figure 8:
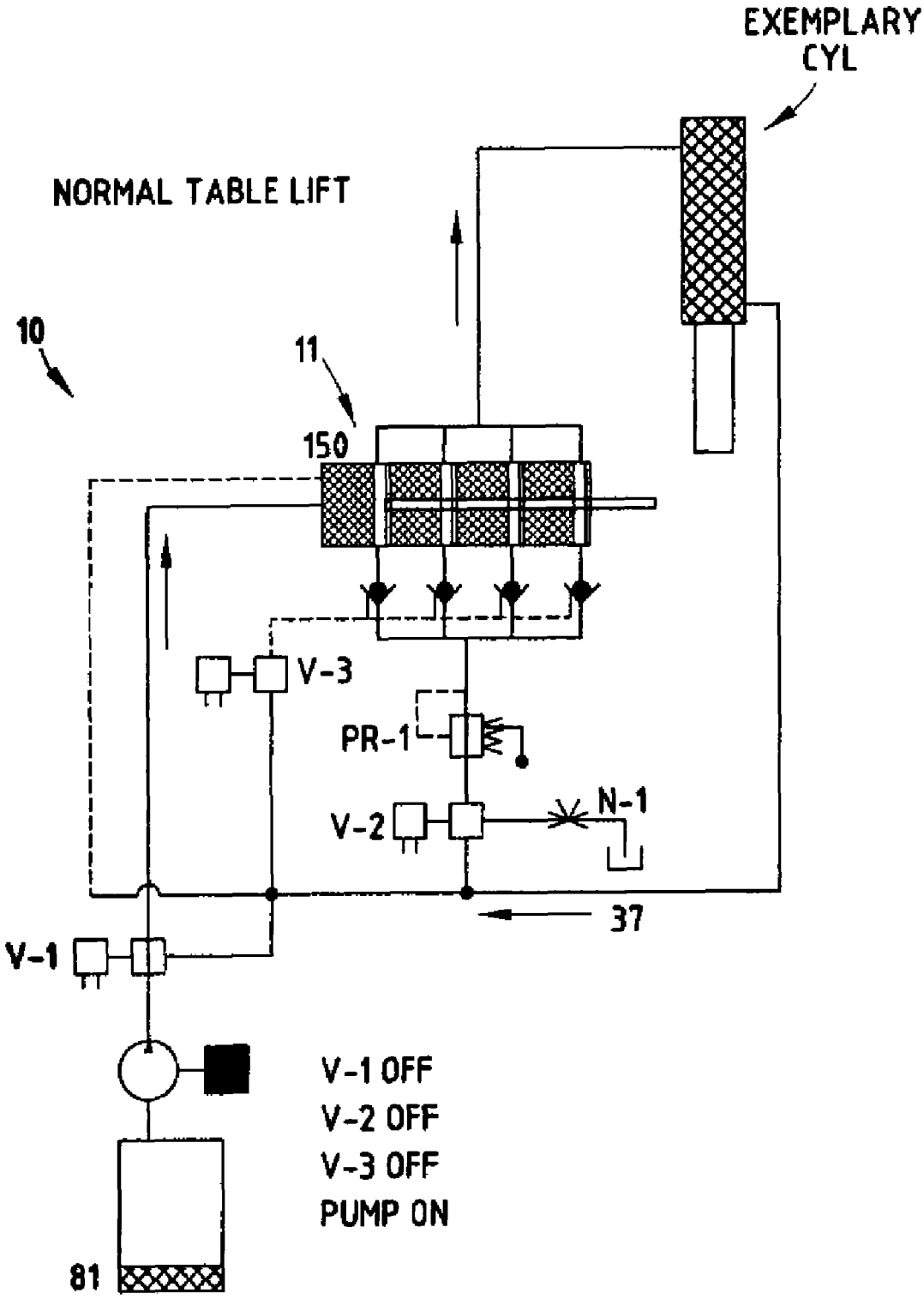

Operate the pump with all valves off to raise the table to the top of the stroke (FIG. 8). When the pump is stopped, the table should stay at that position.

Figure 9:
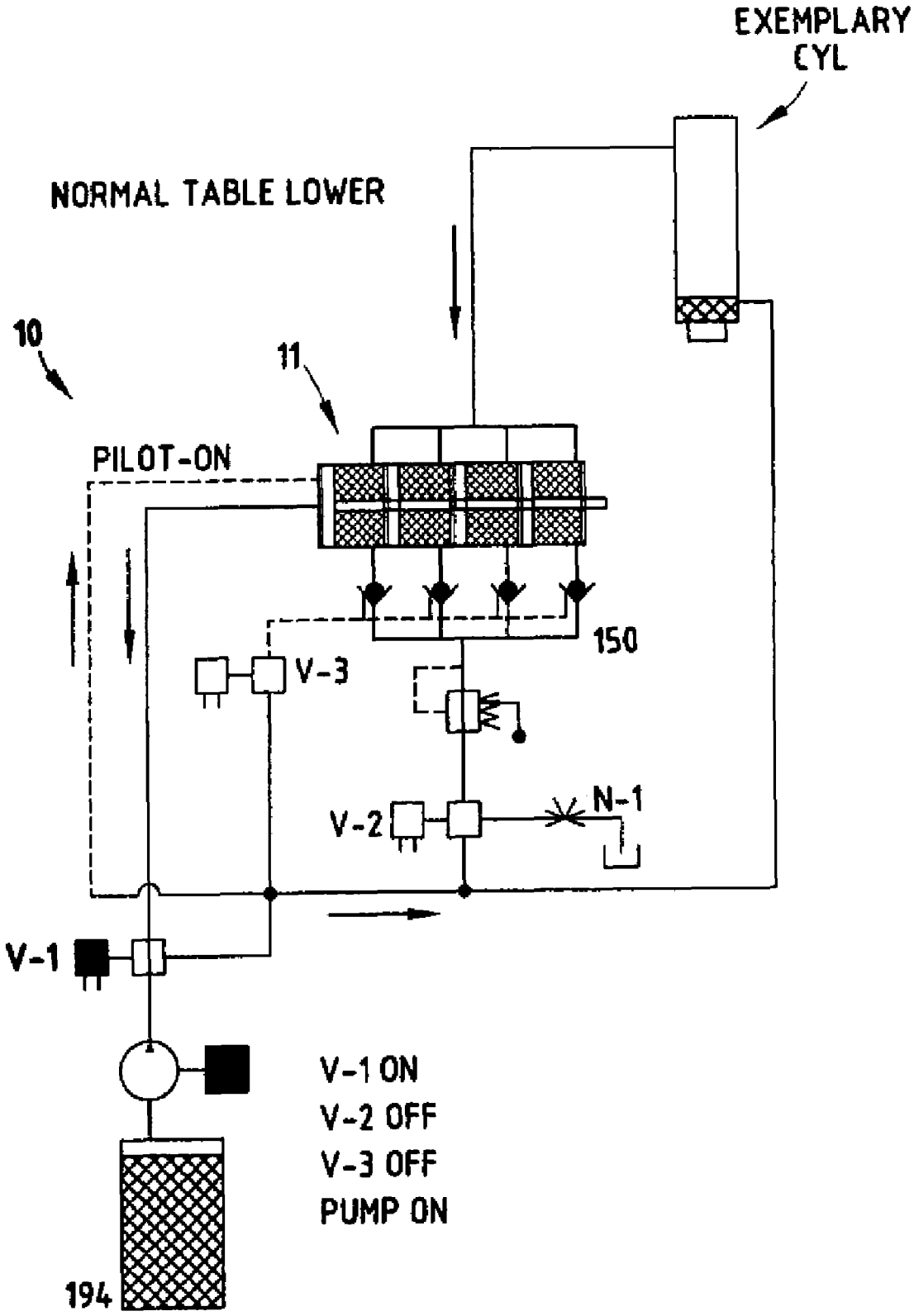

Operate V-1 and start the pump (FIG. 9). This will cause the table to retract. Adjust (N-1) as required per the chart below to obtain smooth no chatter operation of the system. Adjust the flow control on the power unit block for the table retract rate. The retract rate should be about the same as the 12 in/40 sec lift rate.

A prototype of the present lift system was constructed and it was adjusted to handle loads from 3000 lbs to 18000 lbs. The appropriate adjustments were as follows:

| Pump relief valve | Counterbalance | Needle valve* |
|---|---|---|
| 1500 psi for 18000 lb | ccw to the stop | 700/800 psi (C-2) port |
| 1200 psi for 12000 lb | cw one turn from stop | 650/550 psi (C-2) port |
| 800 psi for 10000 lb | same as above | 650/550 psi (C-2) port |
| 700 psi for 8000 lb | cw two turns from stop | 400/450 psi (C-2) port |

-continued

| Pump relief valve | Counterbalance | Needle valve* |
|---|---|---|
| 500 psi for 6000 lb | cw three turns from stop | 300/350 psi (C-2) port |
| 350 psi for 4000 lb | cw four turns from stop | close valve |
| 250 psi for 3000 lb | cw four one half from stop | close valve |

*The needle valve (N-1) should be adjusted for pressure low enough to give smooth operation but the (C-2) port pressure must be high enough to operate the counterbalance pilot allowing the syncrhonizer to function.Pilot pressure is in relation to the setting of the CB. Also, the pressure reducer (PR-1) should show about 300 psi max for heavy loads and about 150 for light loads. It can be adjusted as needed.

The normal operating condition is as follows. Initially, the table is down, corner cylinders fully retracted, valve-1, valve-2, and valve-3 off. To raise the table, start the pump (FIG. 8). Pressure is directed to the synchro causing the synchro to extend, that action will cause the corner cylinders to extend and the table to start going up. Operate the pump to achieve the desired table height then stop the pump. The table will stay at the desired height until a change is required.

To lower the table (FIG. 9), energize valve 1 and start the pump, with valve 2 and valve 3 remaining off. Pump pressure will release the counterbalance valve; pressure will also be directed to the rod end of the corner cylinders. The corner cylinders will begin to retract. Oil from the cap end of the corner cylinders will be directed to the synchro unit forcing the synchro to move toward home position. The table will be lowered and can be stopped at any desired position and will remain until a need arrives to again change the working level.

Uneven lift or short lift height can be corrected as follows. If the table appears not to be synchronized, or cannot be raised to the intended height, the following steps should be taken. First, the operator should check around the machine for objects that are under the machine frame, and clear away anything that would prevent the machine from being lowered completely to the floor. The present hydraulic system allows the table to be at any height for this corrective operation to be done.

To resynchronize the unit, locate the resynchronize control and turn it on. The table will begin to retract. The table will retract at the normal rate until it reaches about 1½ inches from the bottom stop. The last 1½ inches will be faster than the normal rate while the correction action is taking place. The control function will automatically lower the table to the floor, and the system will be restored to correct operation with all cylinders and the synchro cylinder fully resynchronized. Since this synchronizing operation can be performed at any table height, the operator only needs to simply return the table to the operating height desired after this operation has been performed.

A cylinder may need to be changed if a problem is occurring on one corner of the table.

The machine will need to be raised at least 30 inches to remove the cylinder from the frame member. The cylinder must he retracted for this operation. Disconnect the hydraulic lines and plug the fittings on the lines, to prevent contamination and loss of oil. Remove and replace any defective cylinder, including associated attachment components. After the fittings are carefully reinstalled, the table can be lowered to the floor. If the oil loss was minimized, by plugging the lines when the cylinder was exchanged, then minimal additional hydraulic oil will be required to make up the loss. Added oil can be put into the reservoir.

The table can be operated and the procedure outlined above should be followed to purge the cylinder of excessive air. The reservoir level should be checked and oil added as necessary. The resynchronization operation as outlined above can be repeated a number of times, to correct uneven lift, if required.

The principle of this system is that hydraulic fluid is contained in two or more closed loop systems that all function at the same time. One element of the closed loop system is a device with a number of chambers with connected pistons and the other element is an equal number of heavy-duty hydraulic cylinders. Each chamber is filled with fluid and each is connected to an individual cylinder. Any axial movement of either element in the connected pair will result in equal movement in the other element. This is essentially a master and slave system. If two or more of these chambers are assembled into a common package and the pistons are connected together by a common shaft, then an equal amount of fluid would be discharged from all of the chambers, if piston movement occurs. Very careful design and manufacturing control of the elements is required to create the equal volumes necessary for the synchronizing action to occur. A further consideration is that when the systems are initially filled with fluid any trapped air must be expelled. A further consideration is that if any fluid is lost because of slight leakage, then some means must be available for fluid loss correction and restoration of the synchronizing function.

The table lift system design has a circuit that is provided to fill and purge the synchronizer chambers simultaneously, and also a separate circuit to allow the table lift cylinders to be fully retracted simultaneously. The description of these systems is as follows.

Referring to the circuit drawing the following devices are used for these operations: V-1, V-2, V-3, CH-1, CK-2, CK-3, CK-4 and the pump motor.

Air Purge and Resynchronization

The operation of purging the system of air is as follows. Extend the cylinders to raise the table, if necessary (FIG. 8). The purge system will be effective only if the lift cylinders are extended 2 or more inches. This will allow for an exchange of fluid between the cylinders and the reservoir during step 2 below. If the cylinders are already extended, skip this step and go to step 2. With V-1, 2, 3 off, operate the pump/motor (FIG. 8). Oil will be directed through V-1 to port A on the synchronizer. Fluid from the synchronizer will be directed to the four cylinders and cause the cylinders to extend. Fluid from the rod ends of the cylinders will go to the reservoir through V-1

Keep the pump energized until the cylinders are extended at least 3 inches. Stop the pump. At this point if the cylinders are extended 3 inches, then the synchronizer will also be extended about 0.875 inches from home position. The ratio between the illustrated cylinders and the synchro is approximately 3.43/1.

To purge the lift cylinders, energize V-1, V-3 and the pump/motor (FIG. 6). Pressure will be directed to the CB-1 pilot, the rod end of the four cylinders, through V-3 to the pilots of CK1 through 4, and through denergized V-2 through the needle valve N-1. N-1 serves as a flow divider and reduces the system pressure during the lift cylinder retraction operation. The pilot pressure directed to CK-1 through CK-4 will open the check valves and that action opens a circuit that allows fluid from the cap ends of the four cylinders to bypass the synchronizer chambers at ports B-1 through B-4 and go through PR-1 and denergized V-2 to the reservoir. Pressure at the pilot port on the counterbalance valve has opened the counterbalance valve allowing the synchro to retract to home position. The synchro unit will not move, however, because the oil from the cylinders has been redirected to the reservoir through PR-1. PR-1 is a relieving type of reducer and therefore allows the reverse flow, low pressure combination that allows the cylinders to retract without forcing the synchronizer to go to home position.

The four cylinders are constructed with the intent that when fully retracted very little area remains between the piston and the cylinder cap. Because of that fact practically all of the fluid and any trapped air is expelled to the reservoir during this operation. At this point with the cylinders retracted turn off the pump, V-1 and V-3. The cylinders are now retracted, however, the synchronizer remains extended. The oil from the cap end of the cylinders that normally forces the synchro to the home position was redirected to the reservoir.

In order to return the synchronizer to home position, energize V-1, V-2 and the pump/motor (FIG. 7). Fluid through V-2 will be switched from N-1 and sent to PR-1 instead. That will cause the system pressure to rise to the setting of R-1. Fluid will go from V-2 to PR-1 and then through the four check valves to the ports B-1 through B-4 on the synchronizer. Fluid will also be directed through the same port connection to the cap end of the four cylinders.

At this point, fluid is directed to the pilot on CB-1 and to the rod end of the four cylinders from the energized port of V-1 and because N-1 is closed off, that fluid is now the high pressure available from R-1 through V-1. The Cap end of the cylinders is receiving pressure from PR-1, the check valves and the ports on the synchro. Because the pressure at the rod end of the cylinders is higher than the reduced pressure from PR-1 at the cap end, the cylinders will not extend. The fluid that is directed to the ports B-1 through B-4, on the synchro unit will cause the synchro unit to fill with fresh oil from the pump unit, and, because CB-1 is held open by the pilot, the synchro will go to the home position. Keep the pump system energized long enough for the synchro to reach home.

These operations as described have allowed the system to be resynchronized by first allowing the cylinders to go to their natural retracted home position and then returning the synchro system to its home position. Although in this description of the system, it was stated that the lift cylinders should be raised about 3 inches, it could be done at any point, including full cylinder extension. For the resynchronization operation, however, there is no advantage for the cylinders to be extended beyond a few inches. Trapped air, if any, is always to be found at the cap end of the cylinders, and in theory, should be in the last 1 inch of cylinder stroke.

In actual practice, correcting the deficiencies in the lift system should not be required very often. Because of that fact, the required control circuit should only be accessible to qualified personnel and not the machine operator. In a normal production machine that has a hydraulic lift system, the three valves and pump are connected to a programmable controller and operated by timed program sequence. There is a proximity switch located to detect a projection on the synchro rod that triggers the synchro operation when the rod is retracting toward the home position. The proximity switch is positioned to start the synchro sequence during the last 1½ inches of cylinder retraction. This operation can be activated by the use of a synchro system restore switch when the cylinders are extended as much as 12 inches. The table will begin normal controlled ascent until the proximity switch is activated at 1-½ inches and then the synchro operation will take place. This operation can be repeated as many times as required to make sure that the system is synchronized.

Figure 4:
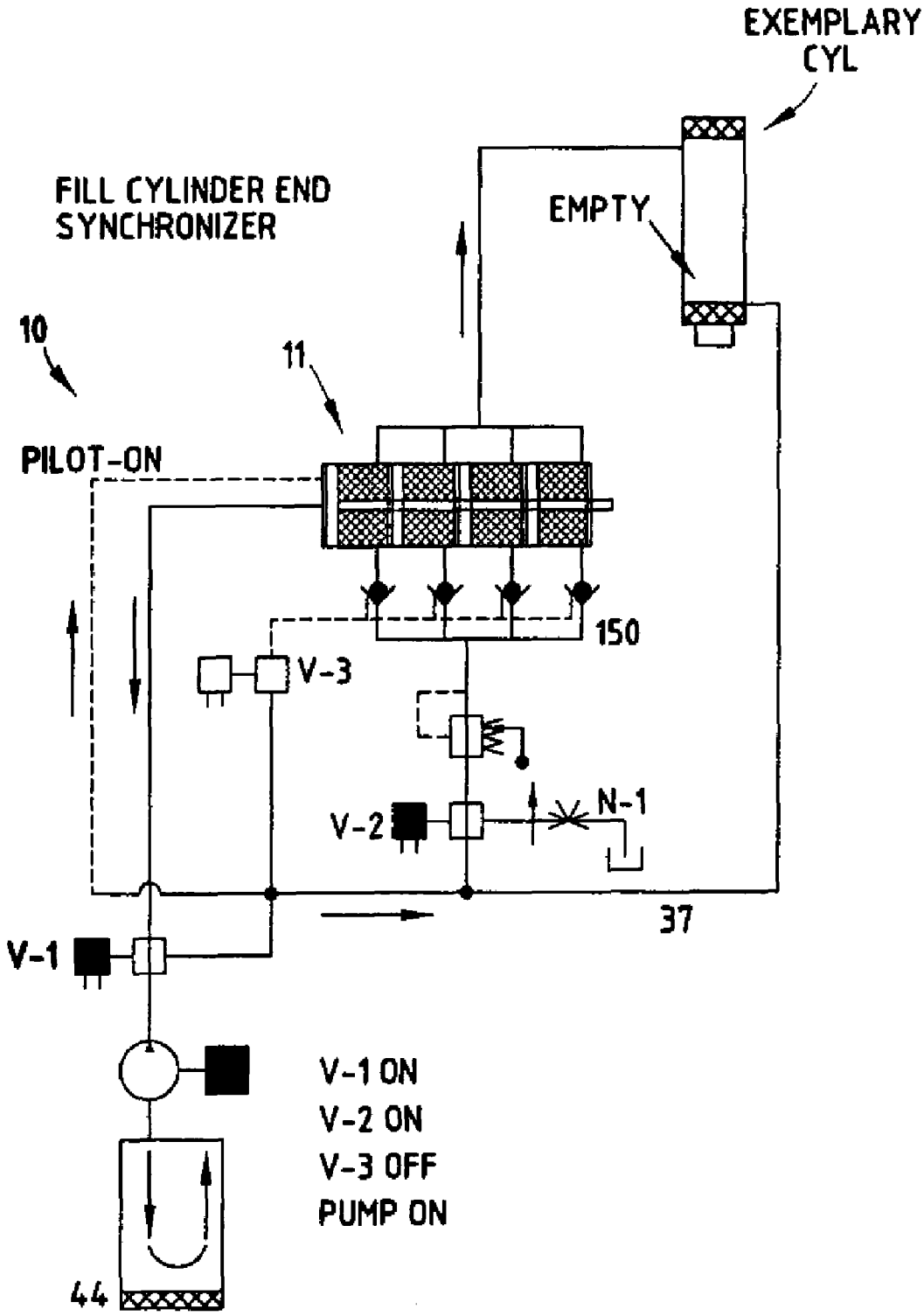

It is possible to utilize the valve arrangement previously described to fill the synchronizer and the cylinders with oil from the reservoir when the system is first started or the system requires a major repair. In this system, the reservoir has by design a large enough fluid capacity to hold all of the oil found in the multi-chambered synchronizer or the connected cylinders. Start by filling the reservoir full (FIG. 2). Operate the pump (FIG. 3). Oil will go through V-1 to the CB-1 port-A and cause the synchro to extend. Keep the pump on until the synchro is fully extended. Now the synchro chambers are filled on the pump side. Then, turn on V-1, V-2 and the pump (FIG. 4). This action will put pressure on the rod end of the cylinders. The cylinders are already retracted so they will not move. Pressure will be directed through V-2 and PR-1 and that will cause oil under reduced pressure to force the synchro to retract and be filled on the cylinder end of the synchro. In this operation oil from the pump end of the synchro chambers was forced back into the reservoir by the transfer operation immediately pumping the oil into the cylinder side of the synchro chambers.

The oil from the reservoir has now been stored in cylinder chambers of the reservoir. The reservoir is empty and must be refilled with oil. With all valves turned off, operate the pump (FIG. 5). Oil will be delivered to CB-1. Port A and the synchro will advance, forcing the stored oil out of the synchro chambers into the cap end of the cylinders. Keep the pump on until the cylinders are fully extended.

By turning on V-1, V-3, and the pump (FIG. 6), the oil from the cylinders will be delivered to the reservoir through the check valves. Keep the pump on until the cylinders are fully retracted. The synchro will remain extended. Turn on V-1, V-2 and the pump (FIG. 7). This action will put pressure on the rod end of the cylinders. The cylinders are already retracted so they will not move. Pressure will be directed through V-2 and PR-1 and the check valves and that will cause oil under reduced pressure to force the synchro to retract and be filled with oil in the cylinder chamber end of the synchro. The system is now ready to be placed into normal production.

Modification

Figure 12A:
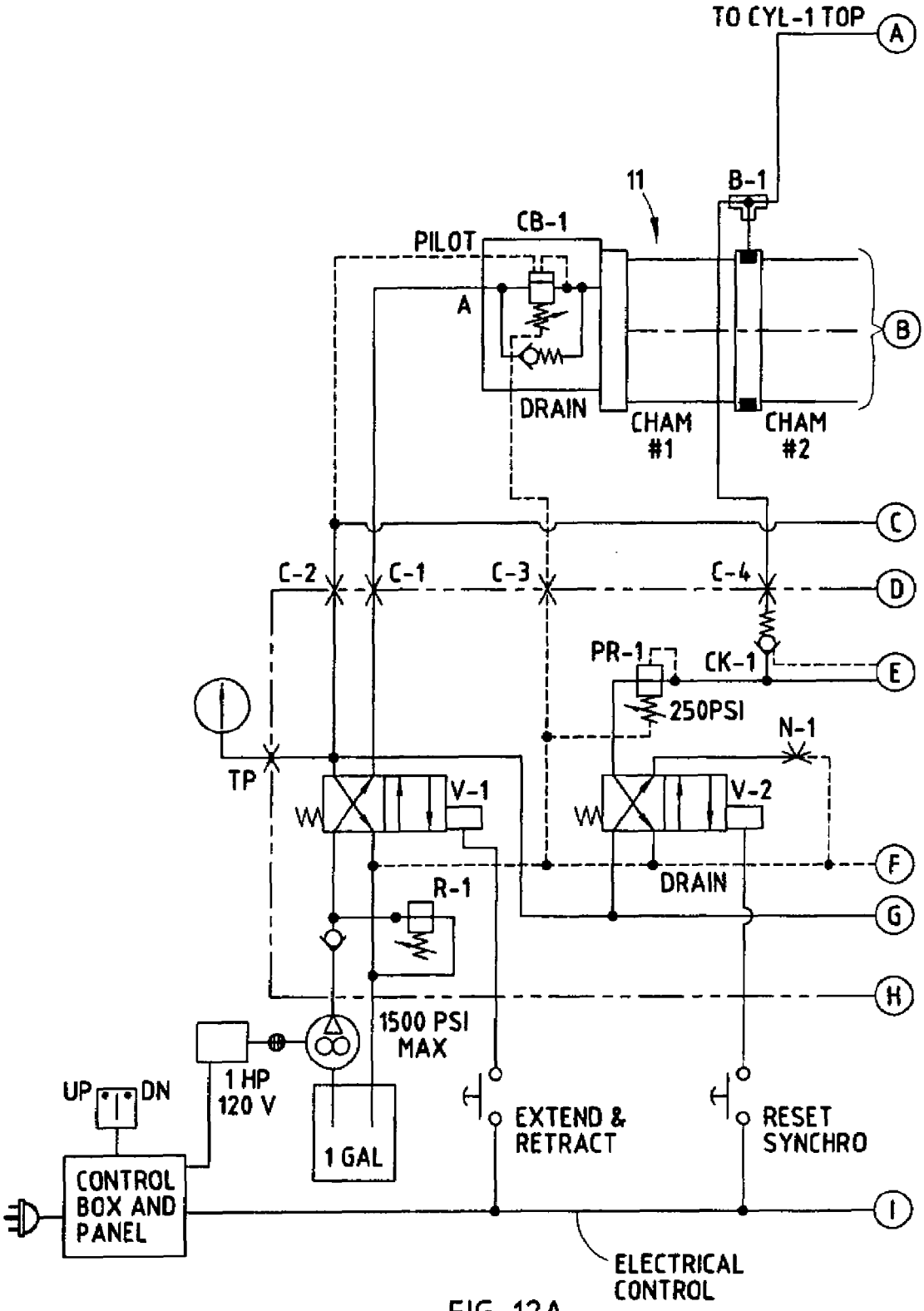
FIGS. 12A-12C combine to form a hydraulic drawing of a modified apparatus similar to that of FIGS. 1A-1C and also embodying the present invention.
Figure 12B:
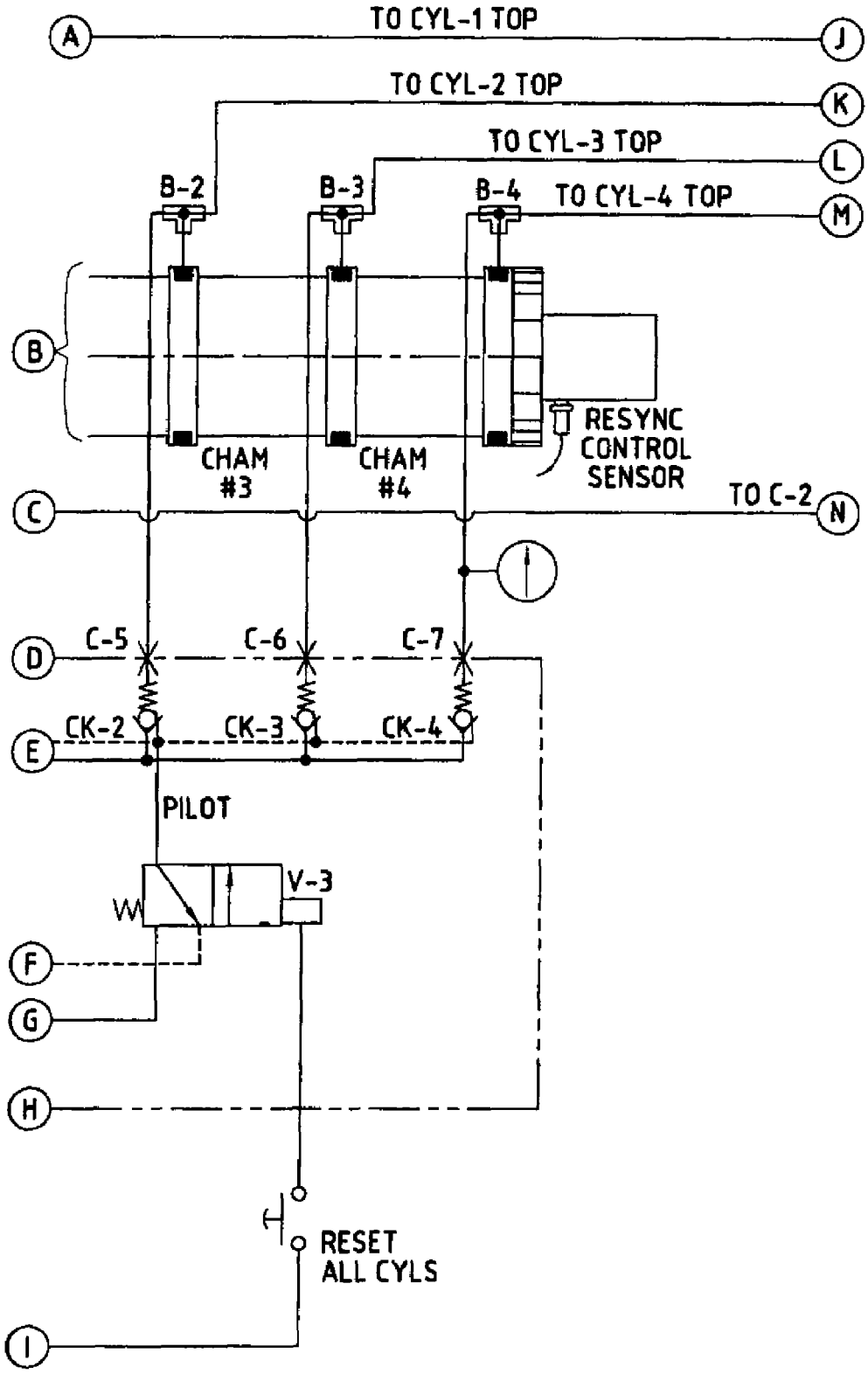
Figure 12C:
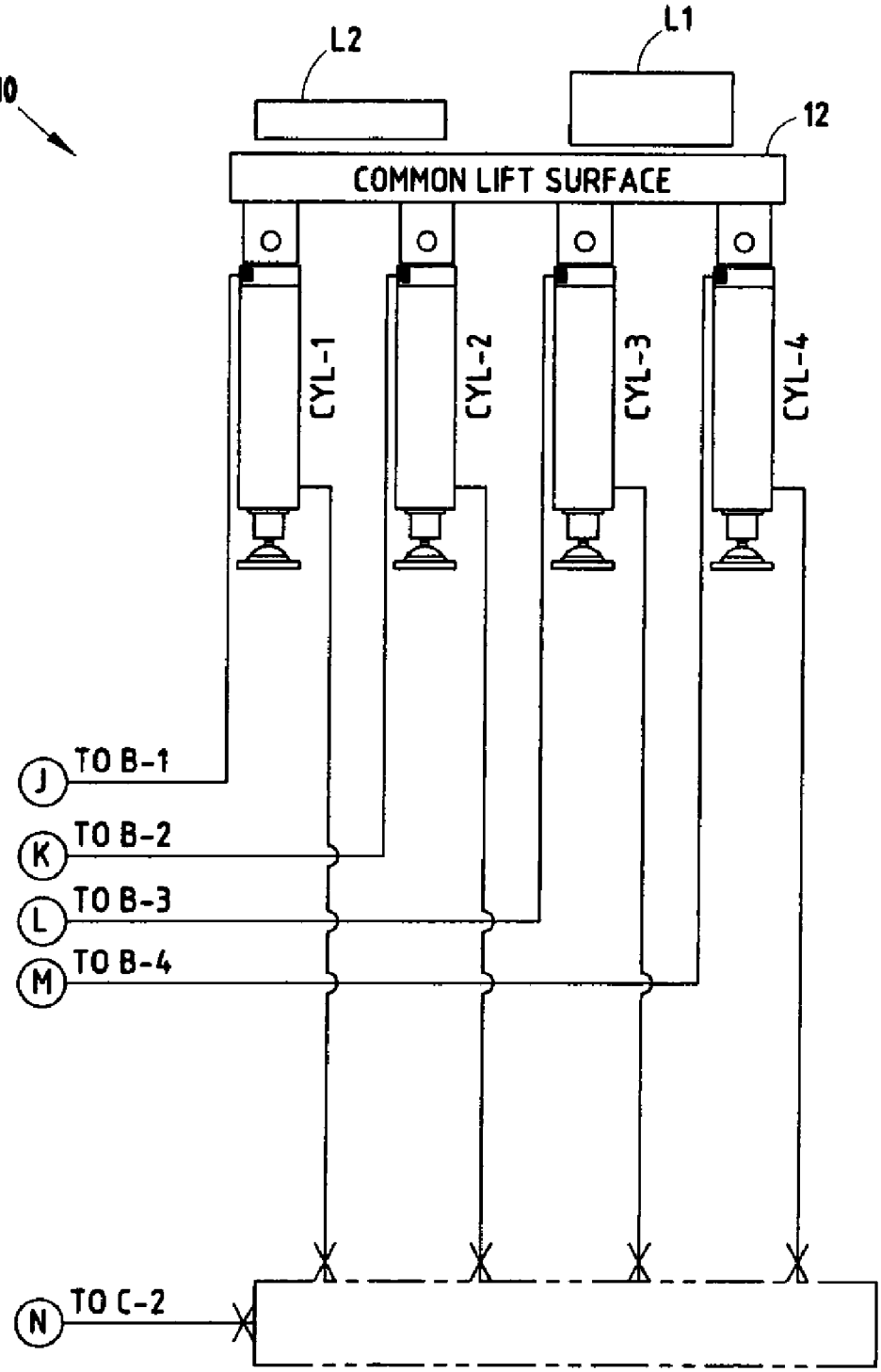

A modified hydraulic system (FIGS. 12A-12C) incorporating a synchronizer includes very similar components as the first-disclosed hydraulic system (FIGS. 1-11B). The components, features, and aspects of the modified hydraulic system are identified using the same number as the identical or similar numbers on the first hydraulic system, but with the addition of the letter "A". This is done to reduce redundant discussion, and to create a more easily understood discussion.

Figure 13:
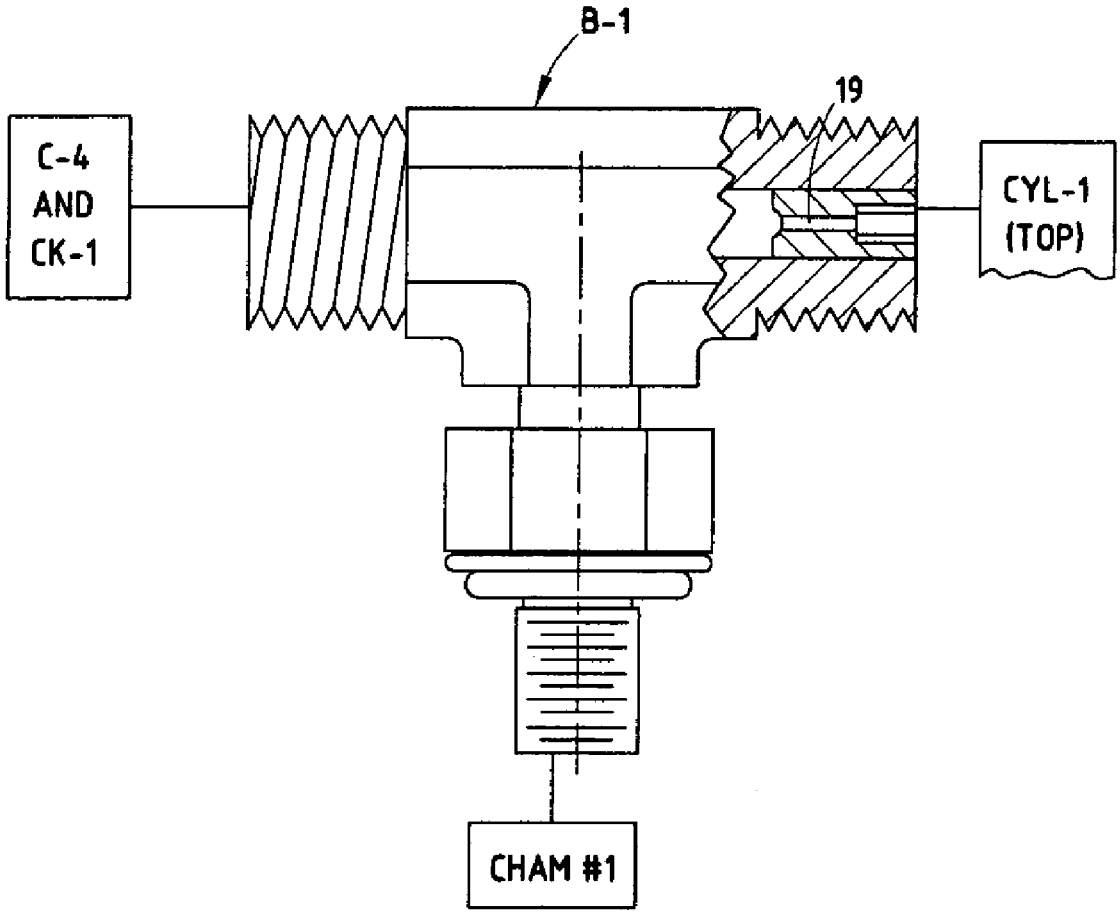
FIG. 13 is a cross sectional view of a T-connector with orifice restricting oil flow therethrough.

In the hydraulic system (FIG. 12A-12C), the T-connectors B-1, B-2, B-3, and B-4 are modified to include a 0.030 inch restrictor orifice 19 (FIG. 13) on each of their output passageways connected by hydraulic lines to the top of the cylinders CYL-1, CYL-2, CYL-3, CYL-4. Notably, the several orifices 19 control oil flow. As illustrated, they are equal in size. However, it is contemplated that they can be different sized orifices, or that one (or more) can be an adjustable orifice, such as when a known offset load is repeatedly handled, in order to more optimally control oil flow and rod movement. The other two passageways of the T-connectors (i.e. the passageway to the various chambers on the synchronizer and the passageway leading to the output ends of the check valves CK-1, CK-2, CK-3, CK-4) are in fluid contact with each other without restriction. Testing has shown that this allows elimination of the flow control FC-1 in the system 10 shown in FIG. 1A, and potentially allows better control of the overall system in regard to synchronization and resynchronization. The hydraulic system (FIG. 12B) also has its test ports relocated to the output connectors C-4, C-5, C-6, and C-7 of the check valves CK-1, CK-2, CK-3, and CK-4. In the system of FIG. 1A, the test ports were located at a top of the cylinders CYL-1, CYL-2, CYL-3, CYL-4.

It is contemplated that the present inventive concepts can be used in a variety of different hydraulic systems. For example, the present inventive concepts can be used where the rods are only partially extended from the cylinders during use. In such hydraulic systems, the present inventive concepts could still be used to provide uniform synchronized control of rod movement (i.e. balanced rod extension even with offset loads), purging of air from oil lines without disconnection and bleeding of hydraulic lines, and/or resynchronization. It is noted that in the illustrated preferred embodiment of the present system, the cylinders all have matched areas, and the synchronizer chambers all have matched areas, but the cylinder and synchronizer areas are not necessarily the same. Specifically, it is contemplated that the synchronizer areas can be a different size than the associated cylinder areas if desired.

Additional Modification

The two additional cylinder synchronized designs described herein (FIGS. 14 and 24) also provide a solution to many problems. Their design is similar in many aspects to the previous disclosure, except this modification is specifically tailored for low operating force systems.

Figure 26:
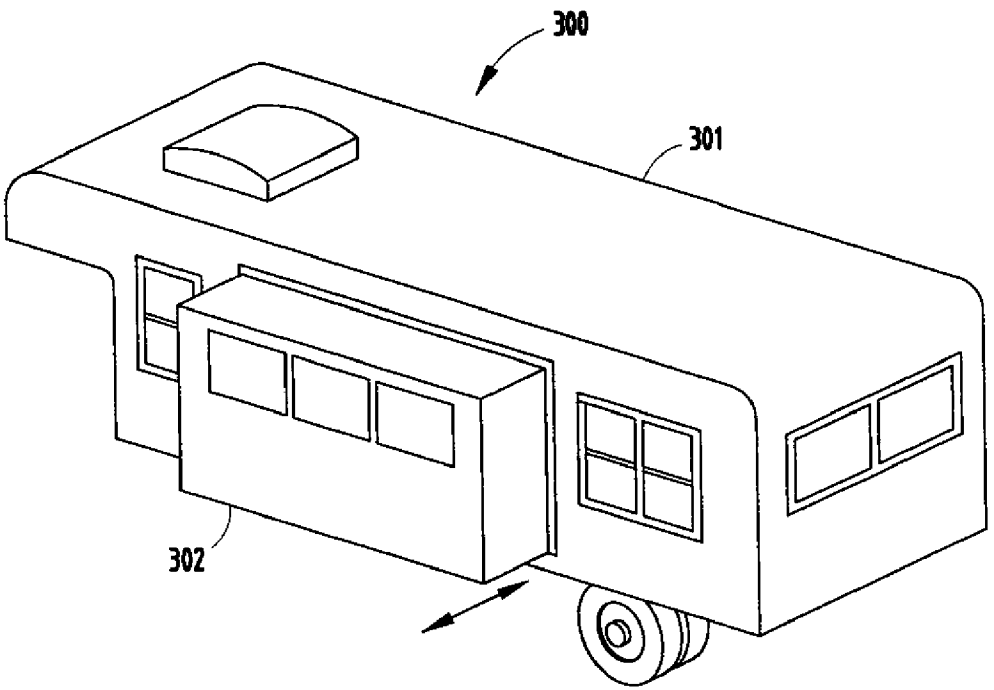
FIG. 26 is a perspective view of the recreational vehicle of FIG. 25, including the extendable room.
Figure 25:
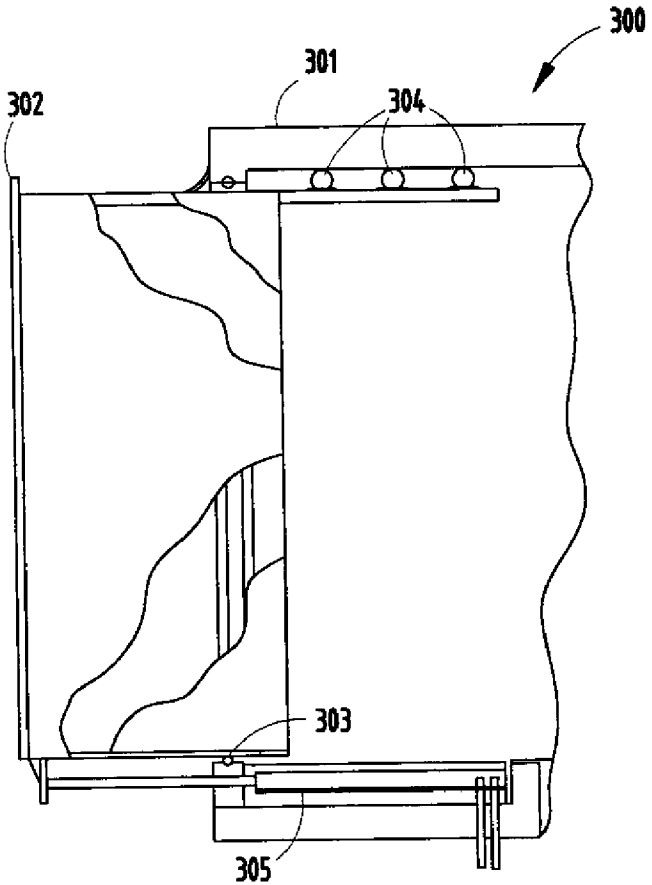
FIG. 25 is a fragmentary side view of the modified hydraulic system used on an extendable room of a recreational vehicle.

In industry in general there is a need for a two cylinder synchronizer that will produce up to 2500 lbs (or less) of thrust. This system can be very useful when it is employed in an industrial lift table (FIGS. 15-23) (such as 2-½' deep and 3' wide table top). Also, in industry, there is a need for a two cylinder synchronized extension system where a large object (such as an extendable room having a dimension greater than 5' to 6' high×8' to 10' wide×4' to 5' deep) such as an extendable room on a recreational vehicle (FIGS. 25-26) can be extended in an accurate smooth non-binding manner while maintaining squareness of the assembly. It is also noted that highly accurate "squared" movement may be required in fixtures, such as when components must be held accurately and in a centered position prior to welding additional components thereto. For example, wheel axle assemblies are an exemplary case in point.

Figures 14, 14A:
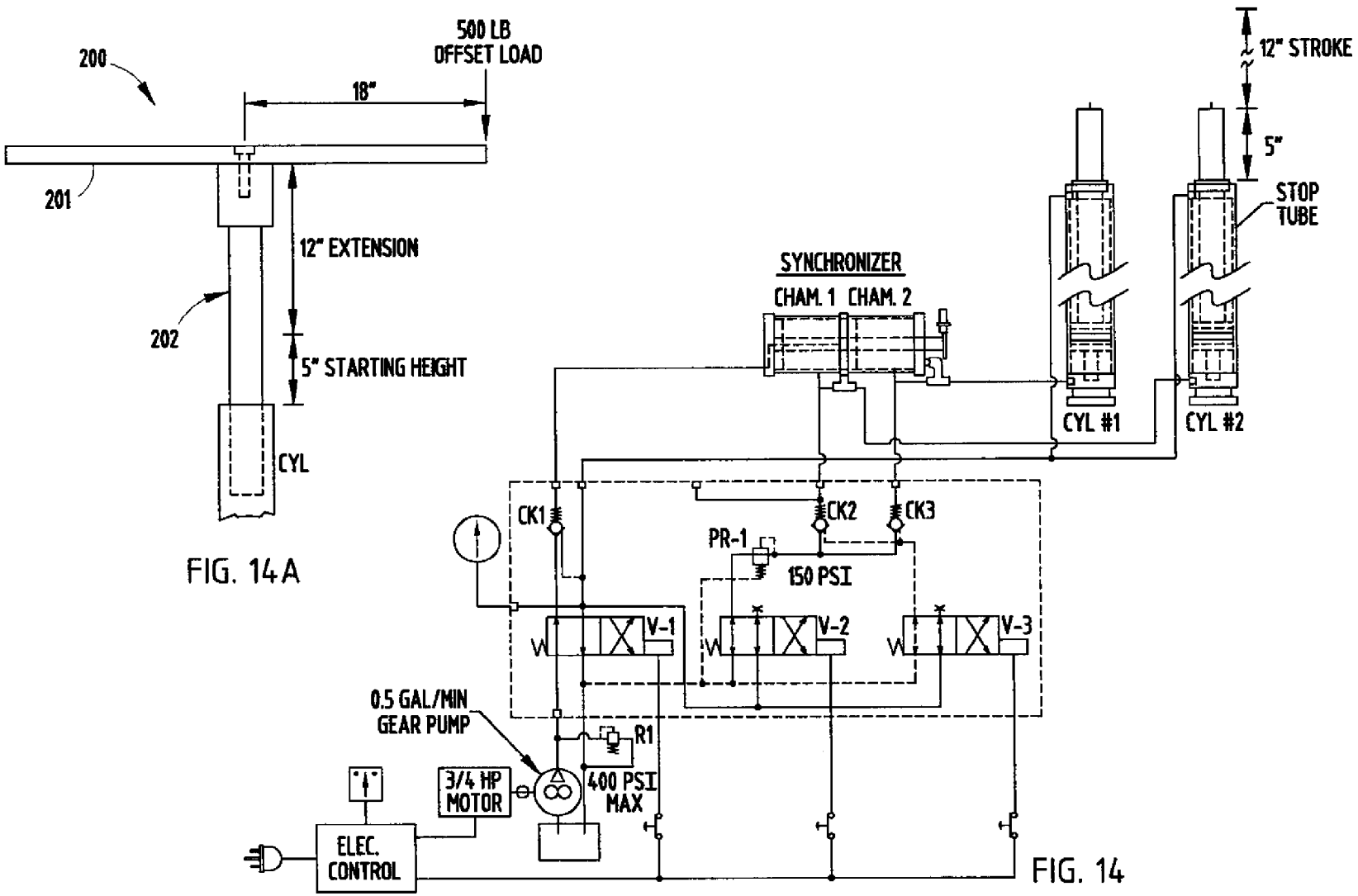
FIG. 14 is a hydraulic drawing showing a modified arrangement.
FIG. 14A is a related schematic drawing of a lift table with an offset load.
Figure 15B:
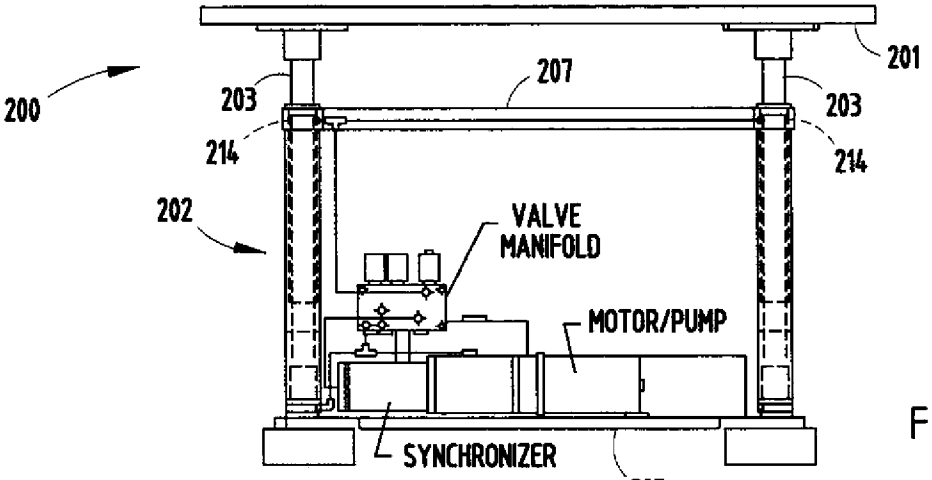
FIGS. 15A-15C are perspective views showing a table apparatus incorporating a modified version of the hydraulic system.
Figure 15C:
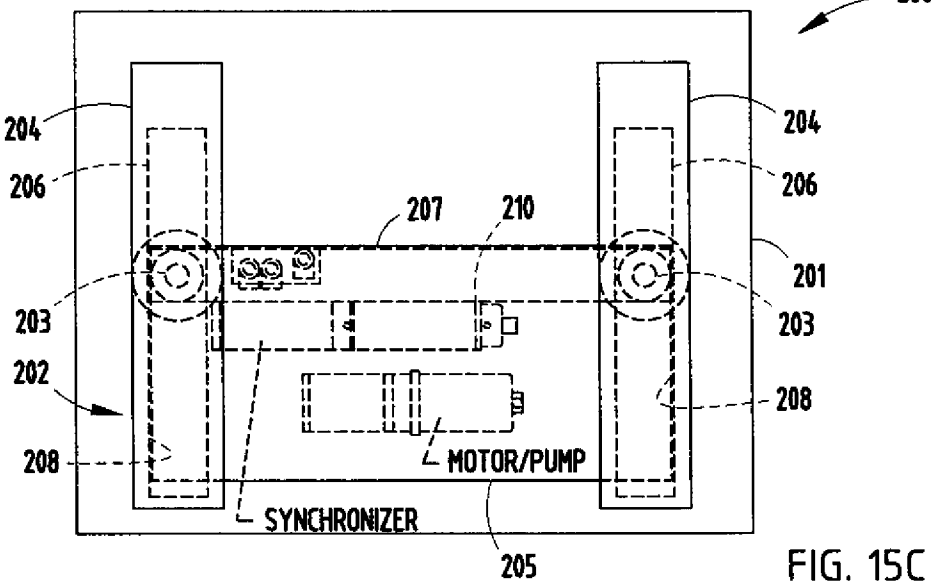
Figure 15A:
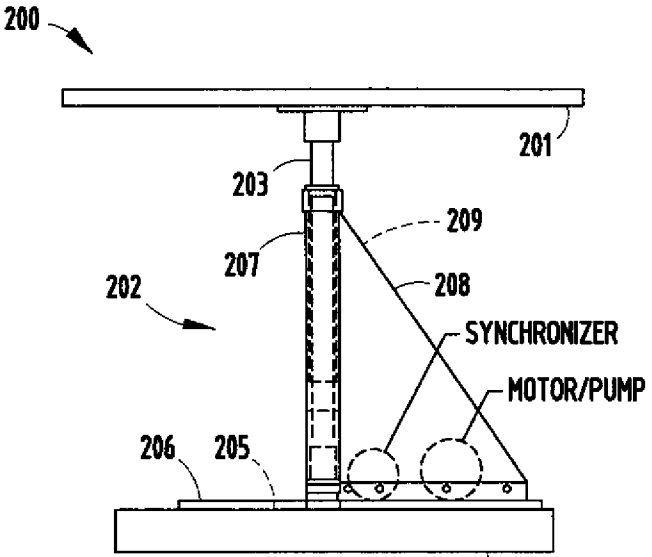
Figure 16B:
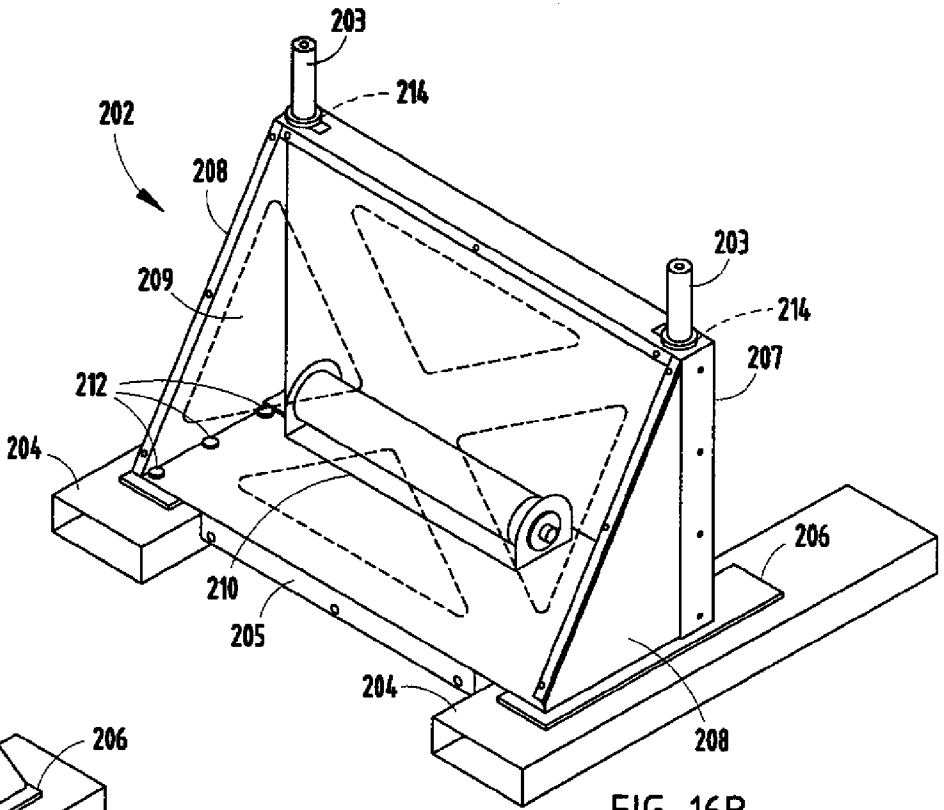
FIGS. 16A-16B are perspective views of the table of FIG. 15A.
Figure 16A:
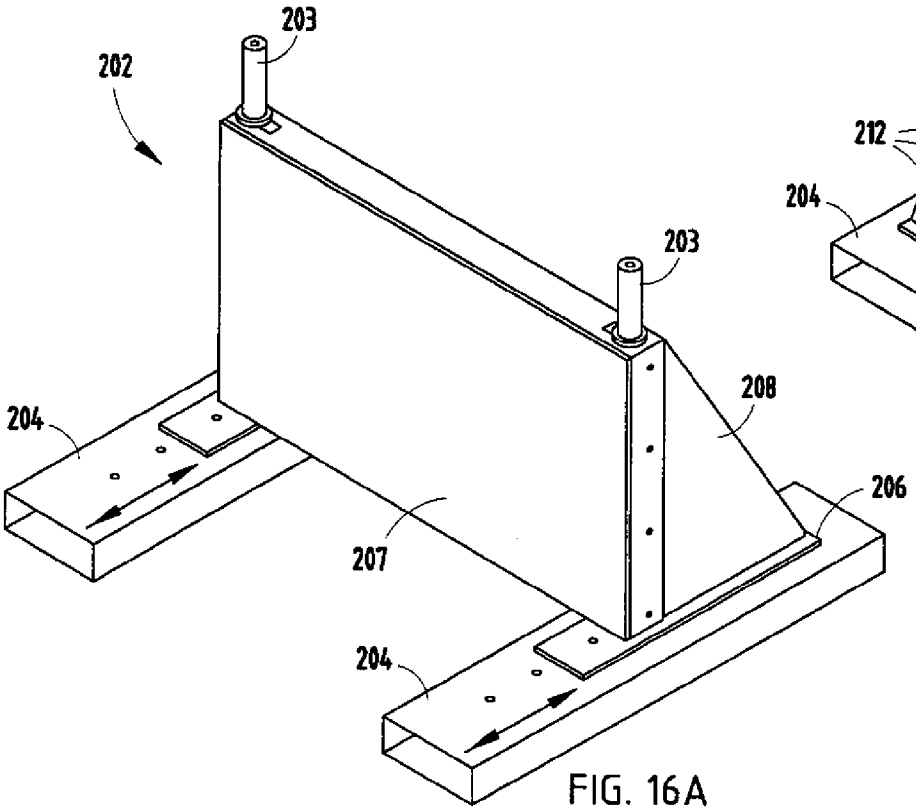
Figure 16D:
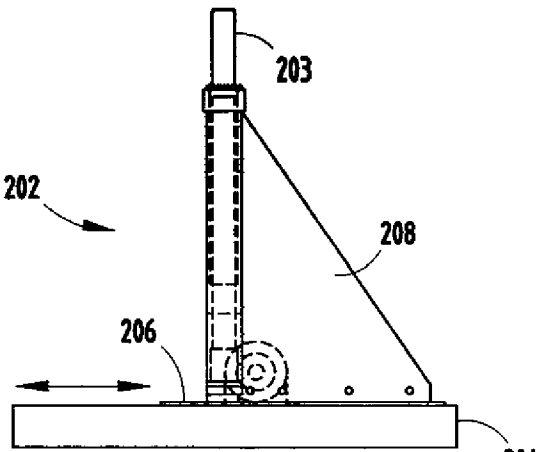
FIGS. 16C-16E are front, side, and top views of the table of FIG. 16A.
Figure 16E:
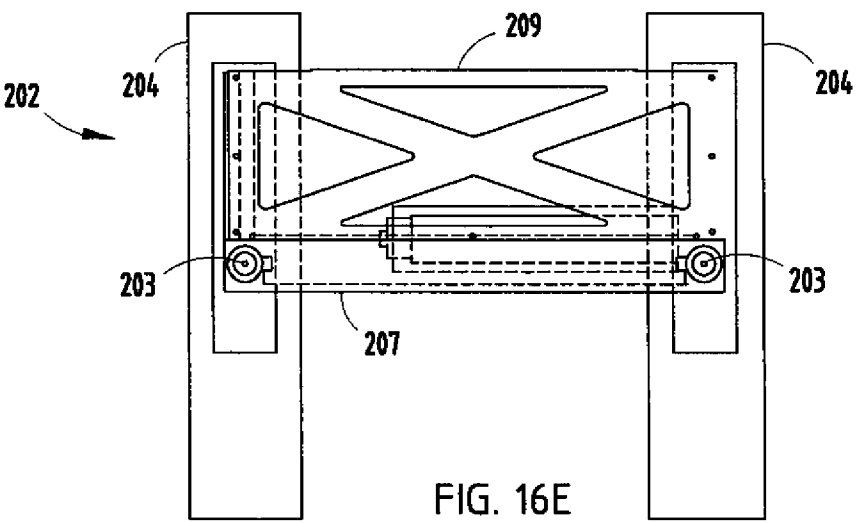
Figure 16C:
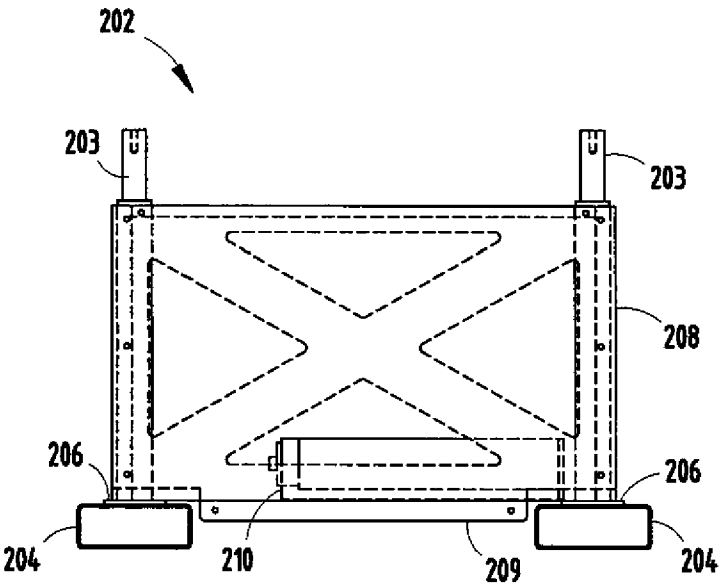
Figure 18:
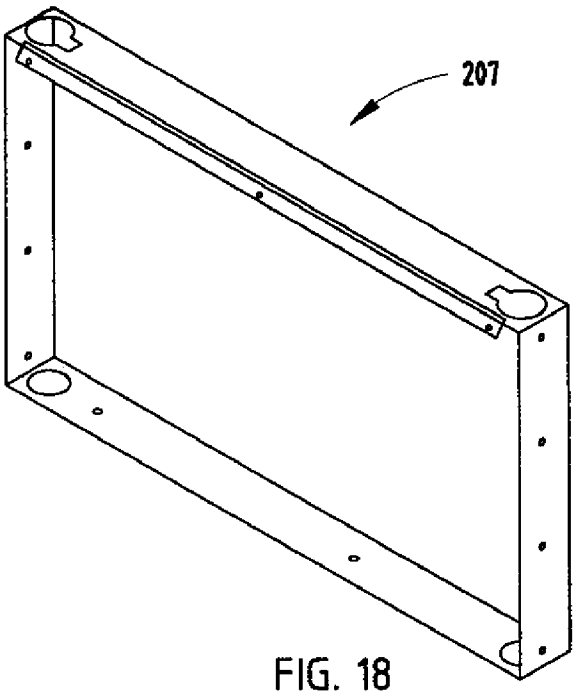
FIGS. 17-23 are views showing components of the table of FIG. 16C.
Figure 19B:
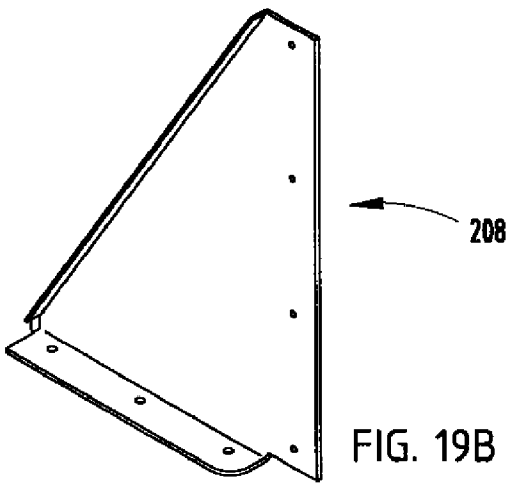
Figure 17:
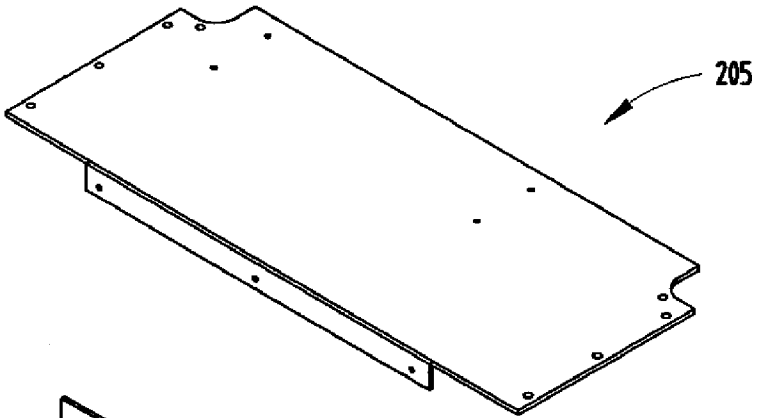
Figure 19A:
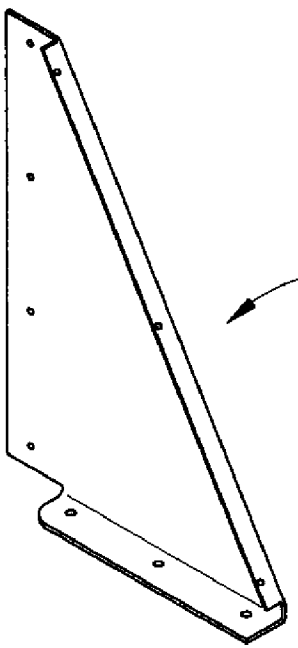
Figure 21:
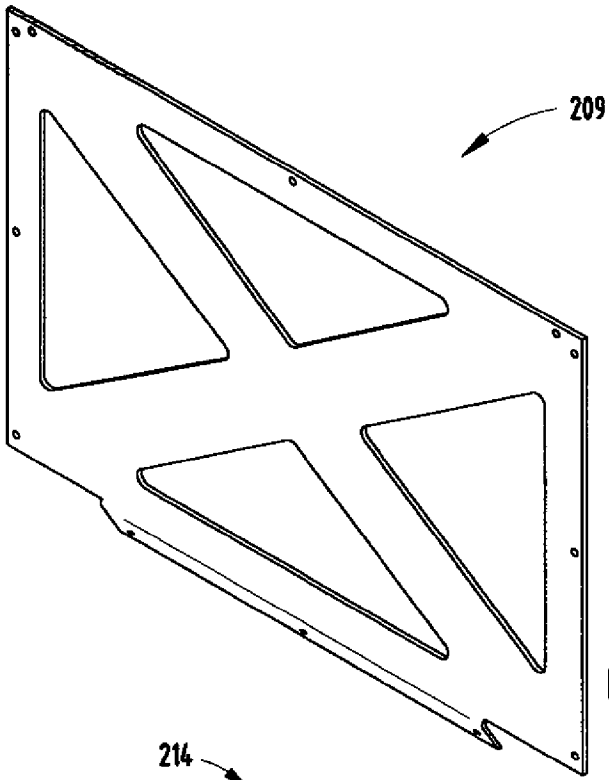
Figure 23A:
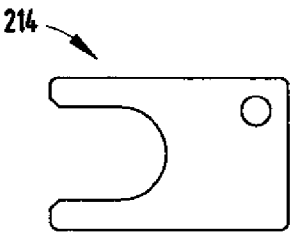
Figure 23B:
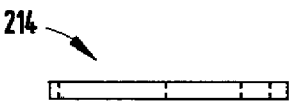
Figure 20:
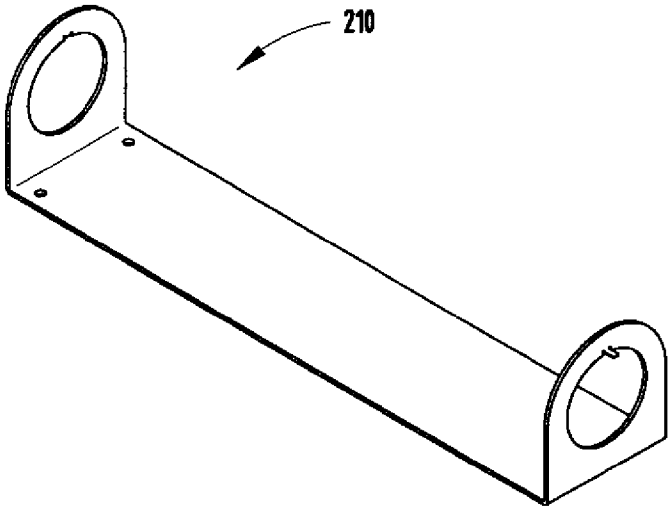
Figure 22A:
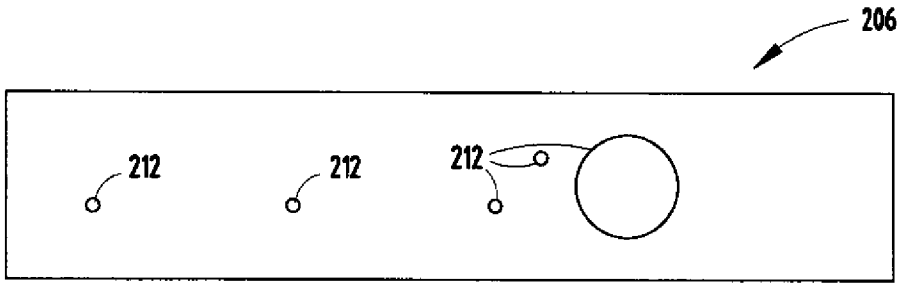
Figure 22B:
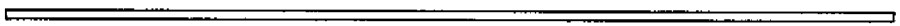
Figure 24:
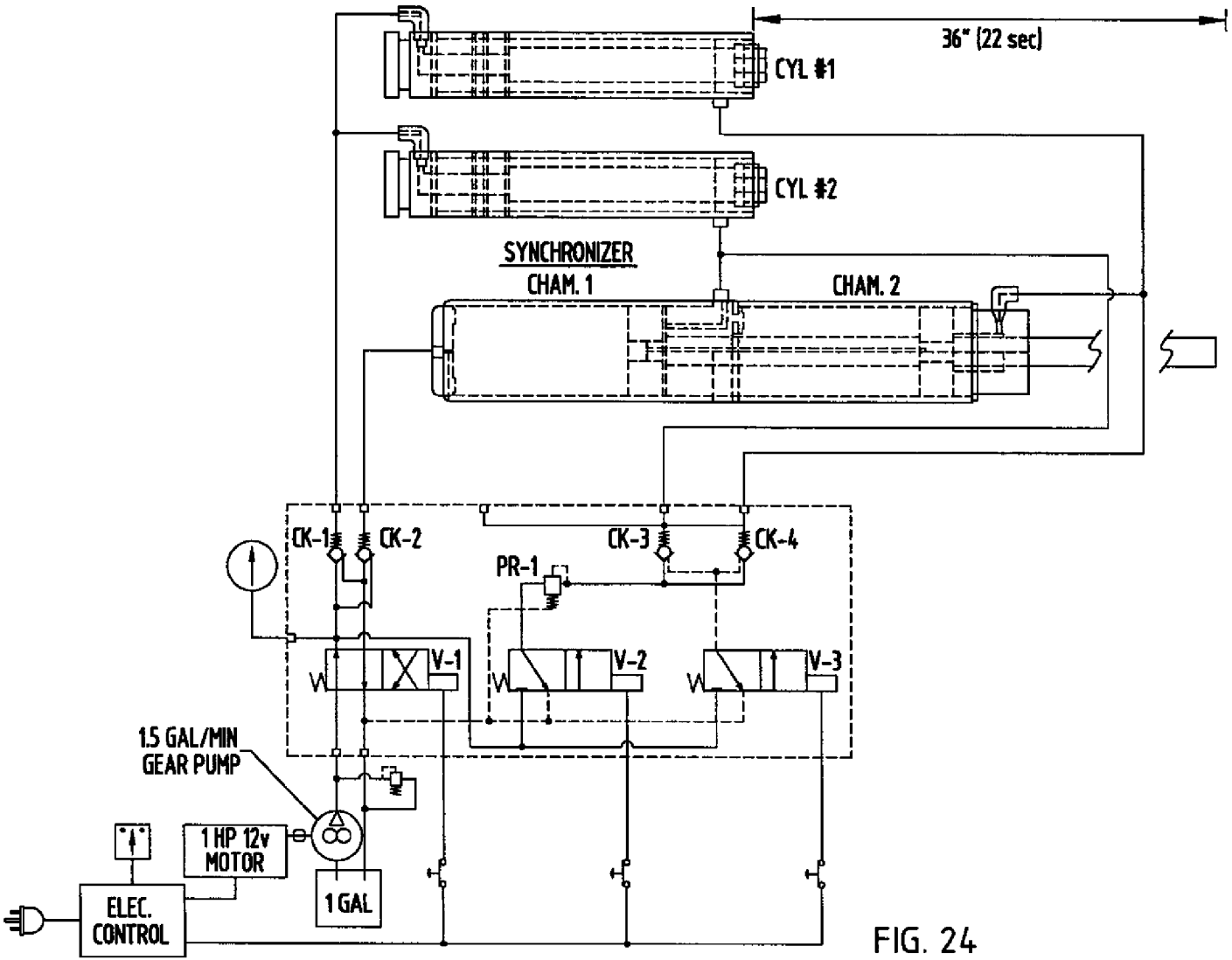
FIG. 24 is a hydraulic drawing showing a second modified hydraulic system.

When used on a table (see FIGS. 15-23) or on an extendable room (see FIGS. 25-26), the extension sequence can be altered by operator command and the cylinders can be resynchronized if necessary at any time. There are four elements that make up the major items of this system:

1. Cylinders
2. Synchronizer
3. Directional valves and manifold
4. Hydraulic pump unit and electric motor The present system of FIGS. 14 and 24 are low pressure systems, operating at a max pressure of 600 psi and more preferably at a maximum pressure of 500 psi. The system of FIGS. 14 and 24 are similar to that of FIG. 1, but since they are low pressure, they are able to eliminate two check valves and a needle valve previously included in FIG. 1 to prevent chatter. Lower pressure lines and connections can also be used, as well as lower volume pumps, lower power motors, and smaller hydraulic oil reservoirs.

The cylinders (FIG. 14) used in the present lift table are preferably capable of handling the side load created when objects mounted to the table are not on the center lines of the two cylinders (i.e., an offset unbalanced load). In the example described, the cylinders are preferably designed to resist 500 lbs of side load at the end of the operating rod when the cylinder is fully extended. The cylinder design chosen as most suitable has a 1½ inch diameter rod and a 12 inch stroke. There is a circular bearing located on the piston to protect the piston seals from side loading during extension or retraction of the cylinder. There is also a shaft bearing located at the rod end of the cylinder for protection of the rod seal from the same side loading. The cylinder tube preferably has side walls strong enough to with stand a side thrust force of approximately 1200 lbs when the cylinder is fully extended.

The synchronizer (FIG. 14) is specifically designed for the hydraulic pressure used in the system. The assembly is held together by a band of weld between the honed outer tubes and the end caps and the center separator block. Tie rods are not used in the illustrated assembly. The hydraulic oil is directed to the two inner chambers through a port located on one of the end caps. Oil is directed to the second chamber by means of a passage way in the center rod. Oil from the hydraulic pump and valves flows into and out of the two chambers by means of the synchronizer end cap port (a). Oil that is held in the two chambers and is isolated from the oil from the pump, is directed to the two cylinders, through a port (b) located in the center separator block and port (c) located in the opposite end cap. The center shafts are fastened to the two pistons by threaded connections. The piston and shaft assembly is designed to keep the threaded assembly in compression and never in tension.

The manifold for this two cylinder system is made of aluminum, however, steel could be used. The system uses three way valves. V-1 is normally open and each time the pump is started, oil passes through the valve, to the synchronizer. That action causes oil from each chamber of the synchronizer unit to be directed to the cap end of the two cylinders. This action causes the two cylinders to start to extend. As long as the motor is energized the cylinder will continue to extend with exactly similar motion. If the pump is stopped the cylinder motion will stop and the present position will be maintained. Ck-1 will not allow oil to return to the tank. If V-1 is energized no action will take place since the flow from the pump will be blocked.

To cause the cylinders to retract both V-1 and V-2 must be energized. That action will cause oil be directed to the rod end of both cylinders thru V-2. There will also be pilot oil from V-2 directed to CK-1. CK-1 will be opened and that will allow oil from the synchronizer chambers to flow thru CK-1 and V-1 to the tank. Because of the oil directed to the rod ends of the cylinders oil will be forced out of the cap end. That oil will be directed to the synchronizer chambers and will force the synchronizer pistons to move as they receive to oil from the cap end of the pistons. As long as V-1 and V-2 are energized the cylinders will continue to retract together until they are fully retracted. Because the synchronizer chambers are designed to have volumes that match the cylinder volume the synchronizer pistons will be bottomed out and all action will stop. Preferably, there is a position sensor provided that is used to indicate that the synchronizer is fully retracted.

A small solid state control unit is provided to operate the valves in the proper sequence for both normal extend/retract and the synchronization operation. Such control systems are known, and need not be described herein for an understanding by those skilled in the art.

The pump and motor are relatively small. The motor could be as small as ¼ hp and the reservoir about 112 cu in of oil. Where the operation of this unit is once every 30 minutes or longer, such as when used on an extendable room of a recreational vehicle or when a table is lifted only once every several minutes, no heat build up is expected. Alternatively, the motor can be up to ¾ hp and the pump operate at 60 cubic inch/minute for faster operation.

The table (FIG. 16A-16B) is particularly well suited for the present hydraulic system of FIG. 14, since the table is low-cost, yet sturdy and also it accurately places the cylinders in a parallel spaced-apart condition. The table 200 includes a tabletop 201 mounted on a base 202. The base 202 incorporates the two cylinder assemblies 203 (e.g., the cylinders from FIG. 14). The base 202 includes a pair of square tubes 204, suitable for engagement by tines of a fork truck. The base includes a stamped control mount 205 setting on a stamped mount plate 206 on the tubes 204, a box-like stamped main frame 207 attached atop the mount plate 206, a pair of stamped triangular side braces 208 attached between the mount plate 206 and the main frame 207, and a back panel 209 secured between the angled edges of the side braces 208. A synchronizer mount 210 attaches to the mount plate 206 and supports a synchronizer cylinder 211 (e.g., the synchronizer from FIG. 14). The mount plate 206 includes a series of holes 212 can be selectively aligned with holes on the tubes 204, thus allowing fore/aft adjustment of the base 202 on the tubes 204. This allows the table 200 to be adjustable to an optimal position relative to the tubes 204. The entire assembly of the base 202 can be accomplished with rivets or screws/bolts. Nonetheless, welding can be used as necessary or as desired. The base is particularly well balanced and stable. A cylinder retainer 214 is provided at each end of the main frame 207 at a bottom (and potentially top) of the cylinder assemblies 203 for accurate location of the extendable cylinder assemblies 203. Further, the cylinder assemblies 203 are aligned with the main frame 207 for maximum stability. The present arrangement is light weight, low cost, and can handle off set loads up to 500 pounds at 18 inches off center from the cylinders with the rods at full extension. (See FIG. 14A.)

To summarize, the over concept of this lift table design is two hydraulic cylinders accurately mounted in a stable lightweight sheet metal frame. It is contemplated that the metal frame can be held together with a minimum of fasteners and no welding.

The synchronized dual cylinder hydraulic system of FIG. 24 that I have designed can be used to move an extendable room of a recreational vehicle, such as the one shown in the slide mechanism as shown in U.S. Pat. No. 6,969,105 (see FIG. 10). As shown in the attached drawing FIG. 24, a modified circuit utilizes the principles of my original design with modifications to fit the needs of a recreational vehicle. I have changed the relation between the synchronizer and the two cylinders. The synchronizer is now controlling the rate of extension by controlling the rate that oil can be forced from the rod end of the two cylinders. The reason to do this is two prevent the two cylinders from drifting forward by themselves. In other words, this prevents the extendable room from being accidentally extended while driving down a highway. The only way that the cylinders can move forward is by forcing the synchronizer pistons to move. I have added an additional pilot operated check to the manifold circuit (ck-1). Ck-1 and CK-2 keep the synchronizer and the two cylinders from moving unless the pump is operated.

There is an additional benefit obtained from this new synchronizer connection system. The benefit is, because it is connected to the rod end of the cylinder, the volume of oil that is being controlled in the synchro chambers is less than the other connection method and therefore the synchro is shorter than the one previously shown. The illustration shows the cylinders fully extended and also shows the synchro retracted in order to demonstrate the exact size and relationship of the synchro chambers and the cylinders. The method of resynchronizing the system is now reversed because of the new connection method.

To correct system faults, such as entrained air, or small oil loss, an operator now first fully extends the two cylinders and then resets the synchro by retracting it. The system will then be ready for normal operation. In this setup, the synchronizer will be fully extended when the cylinders will be fully retracted. The cylinders will be held securely in their retracted position by the synchronizer. The synchronizer can not move inadvertently because of CK-2. Any mechanism that is attached to the two cylinders will be held in place, secure from vibration and shocks.

The recreational vehicle 300 (FIG. 25) includes a main body 301 and an extendable room 302 mounted on bottom rollers 303 and top rollers 304. The room 302 is extendable by operation of the pair of cylinders 305 described in FIG. 24 (and like those shown in FIG. 14). Notably, a more detailed understanding of a particular extendable room and RV construction can be obtained by reference to FIGS. 1*b*, 7, and 10 of Rincoe U.S. Pat. No. 6,969,105. Nonetheless, the present description is sufficient for an understanding by those skilled in the art.

It is contemplated that distance multipliers can be used to increase extension of the room while maintaining a shorter extension of the rods in the cylinders. For example, distance multipliers can include mechanical systems such as rope-and-pulley systems, or lever-and-swing-arm systems, or lever-fulcrum systems, or can include hydraulic solutions such as end-to-end cylinders.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. An apparatus for non-binding, non-skewed movement of an object while maintaining squareness to an original position, comprising:

the object being movable between two locations;

at least two cylinder assemblies adapted to be connected to the object for extending and retracting the object;

a synchronizer having at least two isolated chambers corresponding to the at least two cylinder assemblies, a rod extending axially through the chambers, and pistons mounted on the rod with one of said pistons being located in each of the isolated chambers, the chambers including first and second passageways extending into opposite ends of each of the chambers; an axial passageway extending continuously through the rod and connected to the first passageways for communicating hydraulic fluid to each first passageway;

a hydraulic pump; and a hydraulic circuit operably connecting the pump to the axial passageway of the synchronizer and to the second passageways of the synchronizer and to the at least two cylinder assemblies for controlling and providing synchronized movement of the at least two cylinder assemblies.

2. The apparatus defined in claim 1, wherein the object includes a flat table surface attached to said cylinder assemblies.

3. The apparatus defined in claim 1, wherein the object includes a room on a recreational vehicle attached to said cylinder assemblies.

4. The apparatus defined in claim 3, wherein the hydraulic circuit includes a main fluid line extending from each one of the isolated chambers to an associated one of the cylinder assemblies, and wherein each of the main fluid lines includes a restrictor orifice for restricting flow of hydraulic fluid to or from the associated one cylinder assembly.

5. The apparatus defined in claim 4, wherein the restrictor orifice is at most 0.030 inches in diameter.

6. The apparatus defined in claim 3, wherein the hydraulic circuit includes a pressure regulator counterbalance valve attached to an end of the synchronizer and operably connected to the axial passageway in the rod for regulating pressure of fluid flowing into the axial passageway.

7. The apparatus defined in claim 3, wherein the hydraulic circuit operably connects the pump to the synchronizer and to the at least two lift cylinder assemblies for controlling and providing synchronized movement of the at least two lift cylinder assemblies, the hydraulic circuit including a valving arrangement configured to automatically purge air entrapped in the hydraulic fluid without disconnection of any hydraulic lines and without evacuation or bleeding of the hydraulic lines.

8. The apparatus defined in claim 3, wherein the valving arrangement is operably connected to the hydraulic circuit to, when actuated, automatically re-synchronize positions of the at least two lift cylinder assemblies to each other and to the synchronizer without disconnection of any hydraulic lines and without evacuation or bleeding of the hydraulic lines.

9. The apparatus defined in claim 3, wherein the pump operates at a maximum capacity of about 60 cubic inches per minute.

10. The apparatus defined in claim 3, wherein the cylinder assemblies have a maximum diameter of 1.5 inches and the object weighs at least about 500 lbs.

11. The apparatus defined in claim 3, wherein there are only two of said cylinder assemblies.

12. The apparatus defined in claim 11, wherein the two cylinder assemblies have a same size.

13. The apparatus defined in claim 3, wherein the hydraulic circuit includes a maximum of three pilot operated check valves operably connected to control flow of hydraulic fluid from the cylinder assemblies.

14. The apparatus defined in claim 1, wherein the hydraulic circuit operates at a maximum pressure of 500 psi and the object weighs at least about 500 lbs.

15. The apparatus defined in claim 1, including a motor for operating the pump, the motor being less than about ¾ hp and the object weighs at least about 500 lbs.

16. The apparatus defined in claim 1, wherein the object is at least 2-½'×3' and the object including an item supported thereon weighs at least about 500 lbs.

17. The apparatus defined in claim 3, wherein the object is at least 5' high×8' wide×4' deep.

18. A hydraulic apparatus comprising:

two cylinder assemblies adapted for connection to an object for synchronized extension and retraction to move the object along a defined path while maintaining a precise parallel orientation;

a synchronizer having two isolated chambers corresponding to the two cylinder assemblies, a rod extending axially through the chambers, and pistons mounted on the rod and located in the isolated chambers;

a hydraulic pump; and a hydraulic circuit operably connecting the pump to the synchronizer and to the two cylinder assemblies for controlling and providing synchronized movement of the two cylinder assemblies, the hydraulic circuit including hydraulic fluid and including a valving arrangement configured to automatically purge air entrapped in the hydraulic fluid without disconnection of any hydraulic lines and without evacuation or bleeding of the hydraulic lines.

19. The apparatus defined in claim 18, including a flat table surface attached to said cylinder assemblies.

20. The apparatus defined in claim 18, including an extendable room on a recreational vehicle attached to said cylinder assemblies.

21. The apparatus defined in claim 18, wherein the pump operates at a maximum capacity of about 60 cubic inches per minute.

22. The apparatus defined in claim 18, wherein the cylinder assemblies have a maximum diameter of 1.5 inches and the object weighs at least about 500 lbs.

23. The apparatus defined in claim 18, wherein the hydraulic circuit operates at a maximum pressure of 400 psi and the object weighs at least about 500 lbs.

24. The apparatus defined in claim 18, including a motor for operating the pump, the motor being less than about ¾ hp and the object weighs at least about 500 lbs.

25. The apparatus defined in claim 18, including an object connected to the cylinder assemblies that is at least 2-½'×3' and weighing at least about 500 lbs.

26. The apparatus defined in claim 25, wherein the object is at least 5' high×8' wide and 4' deep.

* * * * *